US010207132B2

(12) United States Patent
Rutherford

(10) Patent No.: US 10,207,132 B2
(45) Date of Patent: Feb. 19, 2019

(54) SELF-CLOSING VENT

(71) Applicant: Flannery, Inc., San Fernando, CA (US)

(72) Inventor: Barry Rutherford, Chatsworth, CA (US)

(73) Assignee: FLANNERY, INC., San Fernando, CA (US)

( * ) Notice: Subject to any disclaimer, the term of this patent is extended or adjusted under 35 U.S.C. 154(b) by 1180 days.

(21) Appl. No.: 13/968,342

(22) Filed: Aug. 15, 2013

(65) Prior Publication Data

US 2015/0047860 A1 Feb. 19, 2015

(51) Int. Cl.

| | |
|---|---|
| ***A62C 2/18*** | (2006.01) |
| ***F24F 13/16*** | (2006.01) |
| ***A62C 2/20*** | (2006.01) |
| *F24F 11/35* | (2018.01) |

(52) U.S. Cl.

CPC ..... *A62C 2/18* (2013.01); *A62C 2/20* (2013.01); *F24F 13/16* (2013.01); *F24F 11/35* (2018.01)

(58) Field of Classification Search

CPC .... A62C 2/18; A62C 2/20; A62C 4/04; A62C 2/22; F24F 2011/0098; F24F 11/35; E04B 1/94; F16K 17/006; A62B 13/00

USPC ..... 454/362, 28, 9, 26, 194; 137/41, 42, 137/404, 410, 429, 430, 202, 78.5, 81.1

See application file for complete search history.

(56) References Cited

U.S. PATENT DOCUMENTS

| | | | | |
|---|---|---|---|---|
| 933,271 A * | 9/1909 | Silberman | A62C 3/04 454/28 |
| 3,301,168 A * | 1/1967 | Schindler | A62B 13/00 137/512.15 |
| 3,437,104 A * | 4/1969 | Richards | F16K 24/042 137/202 |
| 3,645,108 A | 2/1972 | Houk | |
| 3,785,272 A * | 1/1974 | McNabney | A62C 2/06 137/74 |
| 4,195,455 A * | 4/1980 | Chalmers | E04B 9/26 52/506.1 |

(Continued)

FOREIGN PATENT DOCUMENTS

| | | | |
|---|---|---|---|
| DE | 29509134 U1 * | 8/1995 | A62C 2/18 |
| EP | 0616179 A1 * | 9/1994 | F24F 13/12 |

(Continued)

OTHER PUBLICATIONS

Wichmann, Walter (DE 29509134U1), Ventilation element with fire protection, Sep. 28, 1995, Espacenet; translationportal.epo.org.*

(Continued)

*Primary Examiner* — Gregory L Huson
*Assistant Examiner* — Frances F. Hamilton
(74) *Attorney, Agent, or Firm* — Lewis Roca Rothgerber Christie LLP

(57) ABSTRACT

Self-closing vent assemblies configured to provide ventilation during normal ambient conditions and to close during a fire are provided. In one embodiment, the self-closing vent assembly includes a base vent plate having a plurality of apertures and a floating vent plate having a plurality of apertures offset from the apertures in the base vent plate. The floating vent plate is configured to move between a first position spaced apart by a distance from the base vent plate and a second position abutting the base vent plate.

16 Claims, 18 Drawing Sheets

(56) References Cited

U.S. PATENT DOCUMENTS 4,230,174 A * 10/1980 Eubank ..... F24F 13/10 137/112
4,308,887 A * 1/1982 van Bogaert ..... B03C 3/70 137/112
4,475,571 A * 10/1984 Houston, Jr. ..... E03F 5/12 137/315.04
4,667,581 A * 5/1987 Hovland ..... F24F 7/00 454/260
5,161,573 A * 11/1992 Krupp ..... F16K 17/0413 137/526
5,803,805 A * 9/1998 Sells ..... F24F 7/02 454/260
5,957,150 A * 9/1999 Perkins ..... F16K 24/048 137/202
6,022,271 A * 2/2000 Biondo ..... A62C 2/242 454/369
6,604,994 B2 * 8/2003 Achen ..... F24F 13/084 454/271
6,626,201 B1 * 9/2003 Kim ..... E03F 5/042 137/1
6,783,111 B2 * 8/2004 Cash ..... F27D 17/008 137/311
6,827,643 B2 * 12/2004 Eiselt ..... H02B 1/56 174/17 VA
6,910,340 B2 * 6/2005 Nowak ..... F25D 17/045 236/49.5
7,191,845 B2 * 3/2007 Loar ..... A62C 2/065 169/45
7,195,556 B1 * 3/2007 Fichtelman ..... E04D 13/152 454/260
7,413,024 B1 8/2008 Simontacchi et al.
7,431,641 B2 * 10/2008 Darling ..... F24F 3/0442 236/49.3
7,540,118 B2 * 6/2009 Jensen ..... A62C 2/065 169/70
8,062,108 B2 11/2011 Carlson et al.
8,122,904 B2 * 2/2012 Wholey ..... B60K 15/0403 137/429
8,230,650 B1 * 7/2012 Stamps ..... F24F 11/053 52/198
8,262,444 B2 9/2012 Chou
8,448,398 B2 * 5/2013 Perez ..... F24F 13/082 454/271
8,689,815 B2 * 4/2014 Weingarten ..... F16L 55/07 137/202
8,721,410 B2 * 5/2014 Friebel ..... F24F 7/02 454/273
9,163,846 B2 * 10/2015 Cull ..... F24F 7/02
2006/0172696 A1 * 8/2006 Cook ..... E04D 13/174 454/365
2007/0094953 A1 5/2007 Galeazzo et al.
2007/0275652 A1 11/2007 Berkompas
2008/0220714 A1 9/2008 Caruso et al.
2009/0151800 A1 * 6/2009 Salmento ..... F03B 11/00 137/561 R
2009/0286463 A1 11/2009 Daniels
2010/0122500 A1 * 5/2010 Kazmarek ..... E04D 13/178 52/95
2011/0061318 A1 * 3/2011 August ..... A62C 2/06 52/202
2011/0308161 A1 12/2011 Cox et al.
2012/0073216 A1 3/2012 Daniels
2012/0075803 A1 * 3/2012 Kobayashi ..... H05K 7/20572 361/695
2012/0129443 A1 * 5/2012 Bastow ..... F24F 13/16 454/258
2013/0133559 A1 * 5/2013 Salmento ..... F03B 11/00 110/188
2014/0096840 A1 * 4/2014 Weingarten ..... F16L 55/07 137/202
2015/0034188 A1 * 2/2015 Howes ..... F16K 39/04 137/565.01
2015/0247648 A1 * 9/2015 Soderberg ..... F24F 11/04 454/334

FOREIGN PATENT DOCUMENTS

EP 0616179 B1 * 1/1998 ..... F24F 13/12
GB 2029566 A * 3/1980 ..... E06B 7/06
GB 2213719 B * 12/1991 ..... A62C 2/24
GB 2272836 A * 6/1994 ..... A62C 2/18
GB 2312842 A * 11/1997 ..... A62C 2/18
JP 2001-20408 A 1/2001
WO WO 95/21975 8/1995

OTHER PUBLICATIONS

Lex, Ernst (EP 0616179A1), Closing device for an air passage, Sep. 21, 1994, Espacenet; translationportal.epo.org.*
EP 0421841 A1: Amphoux, Andre: Apparatus for Circulation and Installation Containing Such an Apparatus, Apr. 10, 19991.*

* cited by examiner 100
102
111
110
117
116
124
119
3A
123
106
108
134
126
104
109
107
103
105

200
205
212
201
224
5A
203
217
207
212
215
222
216
209
211
217
202
202
5A
206
206
221
204
210
208
221

205
201
224
212
241
203
202
211
210
229
200
200

200
205
214
218
213
217
216
226
215
212
229
204
6A
210
202
203
211
225

241

SELF-CLOSING VENT

FIELD

The present disclosure relates generally to vents, and more particularly to self-closing vents.

BACKGROUND

Homes, offices, and other buildings are commonly provided with vents to provide proper ventilation. These conventional vents may be provided in both external walls (e.g., soffits) of the building to provide airflow between interior rooms of the building and the exterior, and in interior walls (e.g., ceilings, floors) of the building to provide airflow between adjacent rooms of the building. Vents include a plurality of apertures to permit the desired level of air flow through the vents. However, such apertures in the vents may render the building susceptible to damage from an external fire, such as wildfires, brush fires, or forest fires. In particular, rising embers from an external fire may be able to pass through the apertures in conventional vents and thereby spread into the interior of the home, such as into the attic through vents in the soffit.

Accordingly, the present disclosure is directed to self-closing vents configured to provide open airflow ventilation during normal conditions and to close when exposed to a high temperature, thereby preventing fire propagation in order to minimize structural damage to the building.

SUMMARY

The present disclosure is directed to various self-closing vents and vent assemblies configured to close during a fire. In one embodiment, the self-closing vent assembly includes a base vent plate having a plurality of apertures and a floating vent plate having a plurality of apertures offset from the apertures in the base vent plate. The floating vent plate is configured to move between a first position spaced apart by a distance from the base vent plate and a second position abutting the base vent plate. The distance between the base vent plate and the floating vent plate in the first position is approximately ⅛ inch. The floating vent plate includes first and second edges extending in a longitudinal direction and third and fourth edges extending in a direction transverse to the longitudinal direction. The apertures in both the base vent plate and the floating vent plate are rectangular openings disposed in a grid-like pattern. A pair of spaced apart legs protrude from the base vent plate and extend in the longitudinal direction. The pair of legs defining a channel configured to slidably receive the floating vent plate. Each leg also includes an inwardly protruding flange. The inwardly protruding flanges cooperating to define a ledge configured to support the first and second longitudinal edges of the floating vent plate in the first position. The floating vent plate may be configured to move to the second position when subject to an airflow having a velocity between approximately 25 miles per hour and approximately 45 miles per hour.

In another embodiment, the self-closing vent assembly includes a plurality of floating vent plates configured to move between a first position spaced apart by a distance from the base vent plate and a second position abutting the base vent plate. A plurality of supports is coupled to the base vent plate. Each of the plurality of supports includes a lip configured to support transverse edges of the floating vent plates in the first position. Each of the plurality of supports also includes a channel configured to recess a fastener coupling the support to the base vent plate. The floating vent plates may be configured to move to the second position when subject to an airflow having a velocity of approximately 37 miles per hour. The base vent plate also includes a peripheral flange portion having a plurality of apertures configured to receive a plurality of fasteners coupling the self-closing vent assembly to a structure.

In a further embodiment, the self-closing vent assembly includes a first vent plate having a plurality of apertures and a second vent plate having a plurality of apertures. The second vent plate is configured to slide between a first position wherein the apertures in the second vent plate are aligned with the apertures in the first vent plate and a second position wherein the apertures in the second vent plate are offset from the apertures in the first vent plate. A mechanical fusible link configured to bias the second vent plate into the first position. The mechanical fusible link is configured to rupture when subject to a threshold temperature. The second vent plate includes first and second edges extending in a longitudinal direction and third and fourth edges extending in a direction transverse to the longitudinal direction. The mechanical fusible link may be configured to rupture when subject to a threshold temperature of at least approximately 135° F. In one embodiment, the self-closing vent assembly includes a resilient member configured to bias the second vent plate into the second position when the mechanical fusible link ruptures. In one embodiment, the resilient member is a spring. The apertures in both the first vent plate and the second vent plate are rectangular openings disposed in a grid-like pattern. The first vent plate also includes a peripheral flange portion having a plurality of apertures configured to receive a plurality of fasteners coupling the self-closing vent assembly to a structure.

In one embodiment, the self-closing vent assembly includes a pair of spaced apart legs protruding from the first vent plate and extending in the longitudinal direction. The pair of legs define a channel configured to receive the second vent plate. A stiffening leg protrudes from the second vent plate and extends in the longitudinal direction. The stiffening leg is disposed between the pair of legs on the first vent plate. The resilient member is disposed between one leg of the pair of legs on the first vent plate and the leg on the second vent plate. The mechanical fusible leg is disposed between the other leg of the pair of legs on the first vent plate and the leg on the second vertical plate. Each leg of the pair of legs on the first vent plate further includes an inwardly protruding flange. The inwardly protruding flanges cooperate to define a ledge configured to support the first and second longitudinal edges of the second vent plate. The stiffening leg is spaced apart from one of the legs on the first vent plate by a first distance when the second vent plate is in the first position, and the stiffening leg is spaced apart from the one leg on the first vent plate by a second distance greater than the first distance when the second vent plate is in the second position.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

Embodiments of a self-closing vent assembly according to the present disclosure are described with reference to the following figures. The same reference numerals are used throughout the figures to reference like features and components. The figures are not necessarily drawn to scale.

DETAILED DESCRIPTION

The present disclosure relates to self-closing vent assemblies configured to be installed in various structural members to provide proper airflow ventilation, such as in a soffit or any other wall of a building (e.g., a wall separating the exterior of a building from the interior). Additionally, the self-closing vent assemblies are configured to be installed in structural members formed of various materials, such as drywall, stucco, or plaster. The self-closing vent assemblies of the present disclosure are configured to close when the ambient temperature or airflow velocity exceeds a threshold, such as during a fire. In some embodiments, the self-closing vent assemblies are configured to retrofit existing vents into self-closing vents. In other embodiments, the self-closing vent assemblies are prefabricated and configured to be installed in a fully assembled state.

Figure 1:
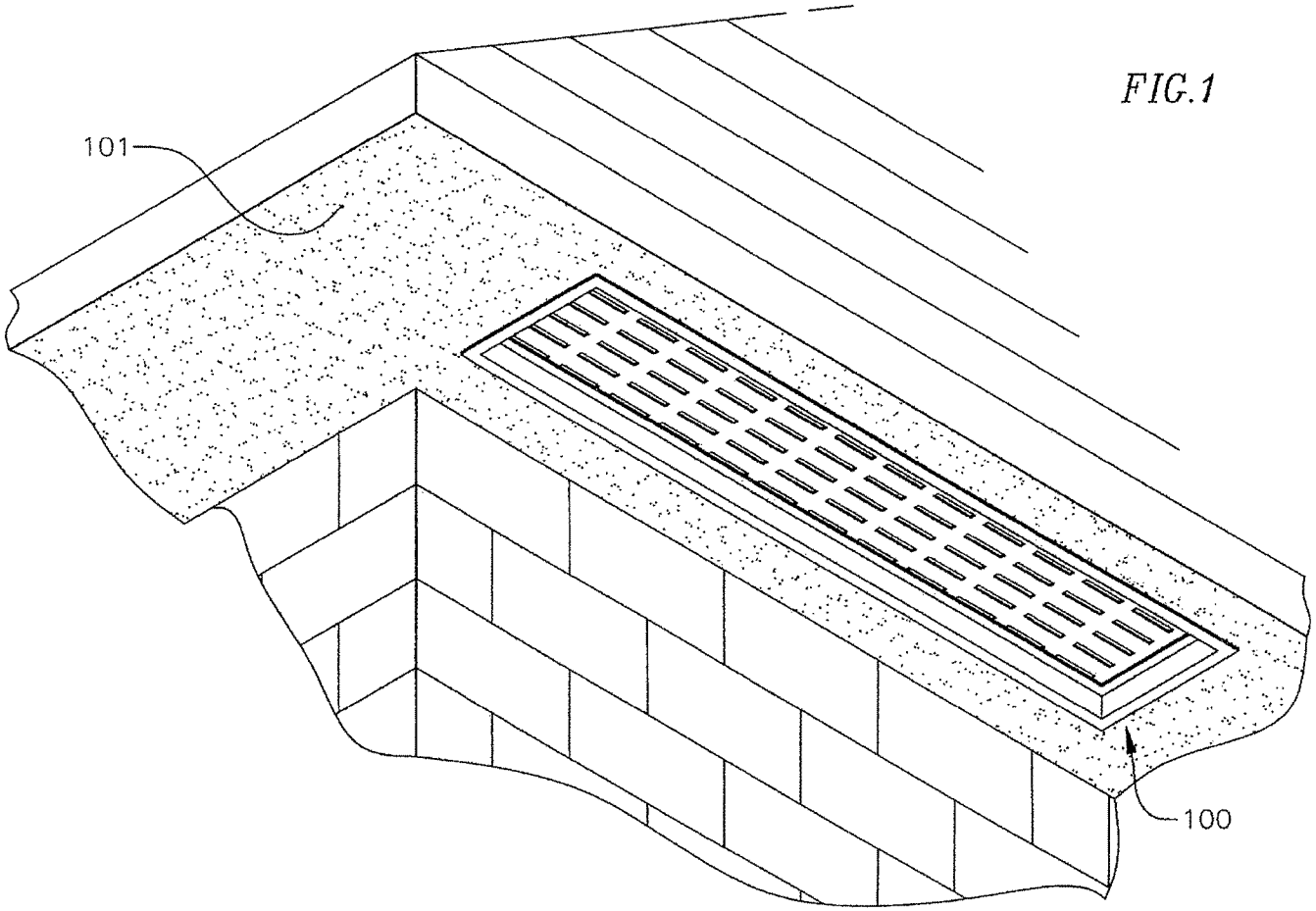
FIG. 1 is a perspective view of a self-closing vent according to one embodiment of the present disclosure installed in a soffit of a house.

With reference now to FIG. 1, an embodiment of a self-closing vent assembly 100 is illustrated installed in a soffit 101 of a building. Although only one self-closing vent assembly 100 is illustrated, it will be appreciated that any other appropriate number of self-closing vent assemblies 100 may be provided along the length of the soffit 101. The appropriate number of self-closing vent assemblies 100 is determined by the length of each of the self-closing vent assemblies 100 and the desired ventilation. In one example embodiment, the self-closing vent assembly 100 is approximately 24 inches long. In another example embodiment, the self-closing vent assembly 100 is approximately 120 inches long. It will be appreciated, however, that the length of the self-closing vent assembly 100 is not limited to the lengths recited above, and the self-closing vent assembly 100 may be any other suitable length, such as between approximately 12 inches and 120 inches or more. Additionally, although the self-closing vent assembly 100 is illustrated in a soffit 101, it will be appreciated that the self-closing vent assembly 100 may be provided in any other part of the building, such as in a ceiling or a floor.

With reference now to the embodiment illustrated in FIGS. 2A-2D, the self-closing vent assembly 100 includes a base frame 102 and a floating vent plate 103 configured to move between an open position, during normal ambient conditions, and a closed position during a fire. As described in more detail below, when the floating vent plate 103 is in the open position, the self-closing vent assembly 100 is configured to permit air to freely pass through the self-closing vent assembly 100 to provide proper airflow ventilation. When the floating vent plate 103 is in the closed position, the self-closing vent assembly 100 is configured to prevent air and other matter, such as rising embers, from passing through the self-closing vent assembly 100. The base frame 102 includes a base vent plate 104. In the illustrated embodiment, the base vent plate 104 is a rectangular plate having first and second longer edges 105, 106, respectively, extending in a longitudinal direction and first and second shorter edges 107, 108, respectively, extending in a direction transverse to the longitudinal longer edges 105, 106. It will be appreciated that the base vent plate 104 may have any other suitable shape, such as square or circular. The base vent plate 104 includes a plurality of apertures 109. In the illustrated embodiment, the apertures 109 are rectangular openings or slots disposed in a grid-like pattern, although it will be appreciated that the apertures 109 may have any other suitable shape, such as square or circular, and still fall within the scope and spirit of the present disclosure. In one embodiment, the apertures 109 are rectangular slots having a width of ⅛ inch, a length of 1 inch, and which are spaced apart 1½ inches on-center lengthwise and ½ inch on-center laterally, although the apertures 109 may have any other suitable size and spacing.

Figure 2A:
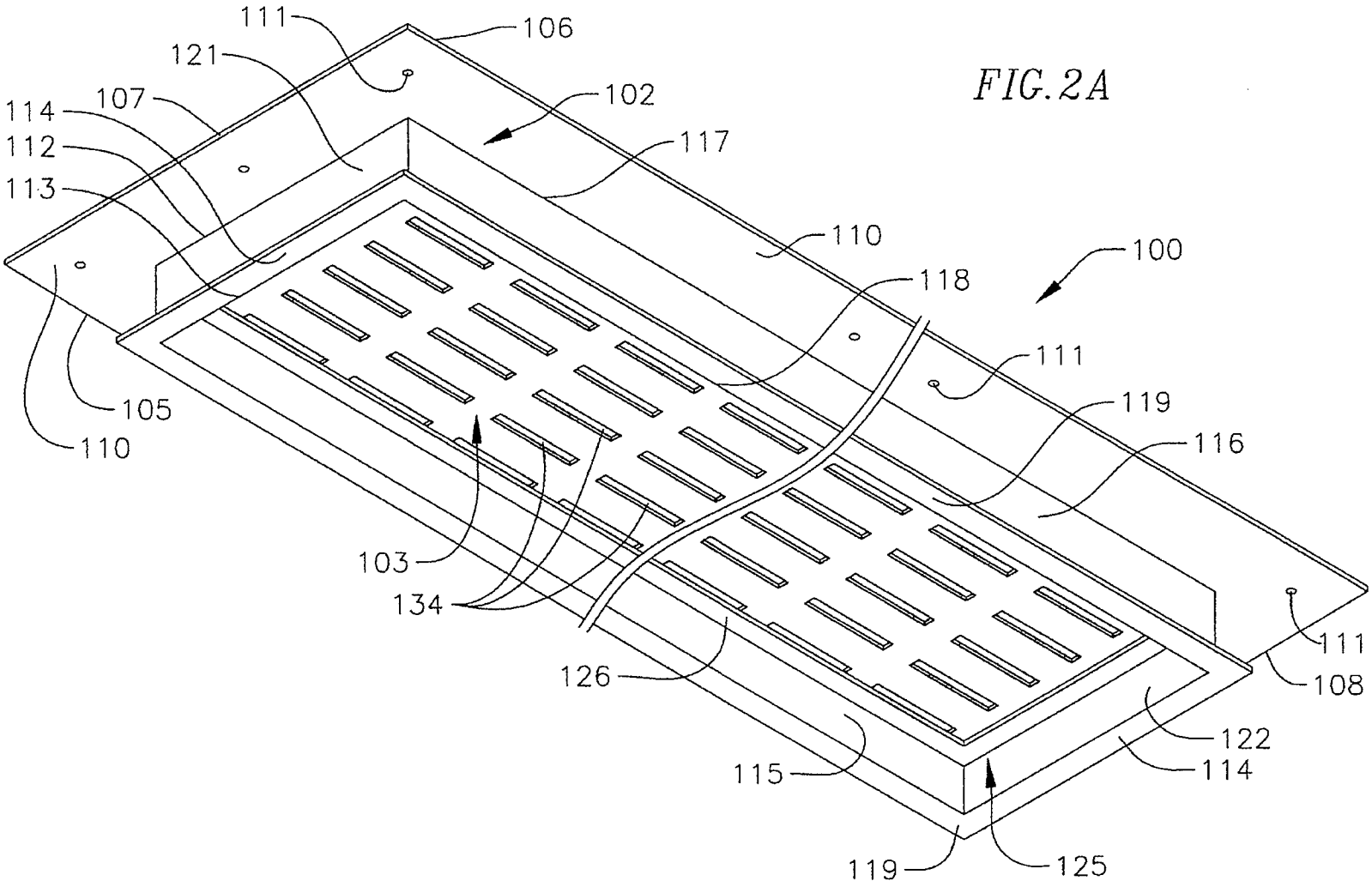
FIG. 2A is a perspective view of the self-closing vent of FIG. 1.
Figures 2B, 2C:
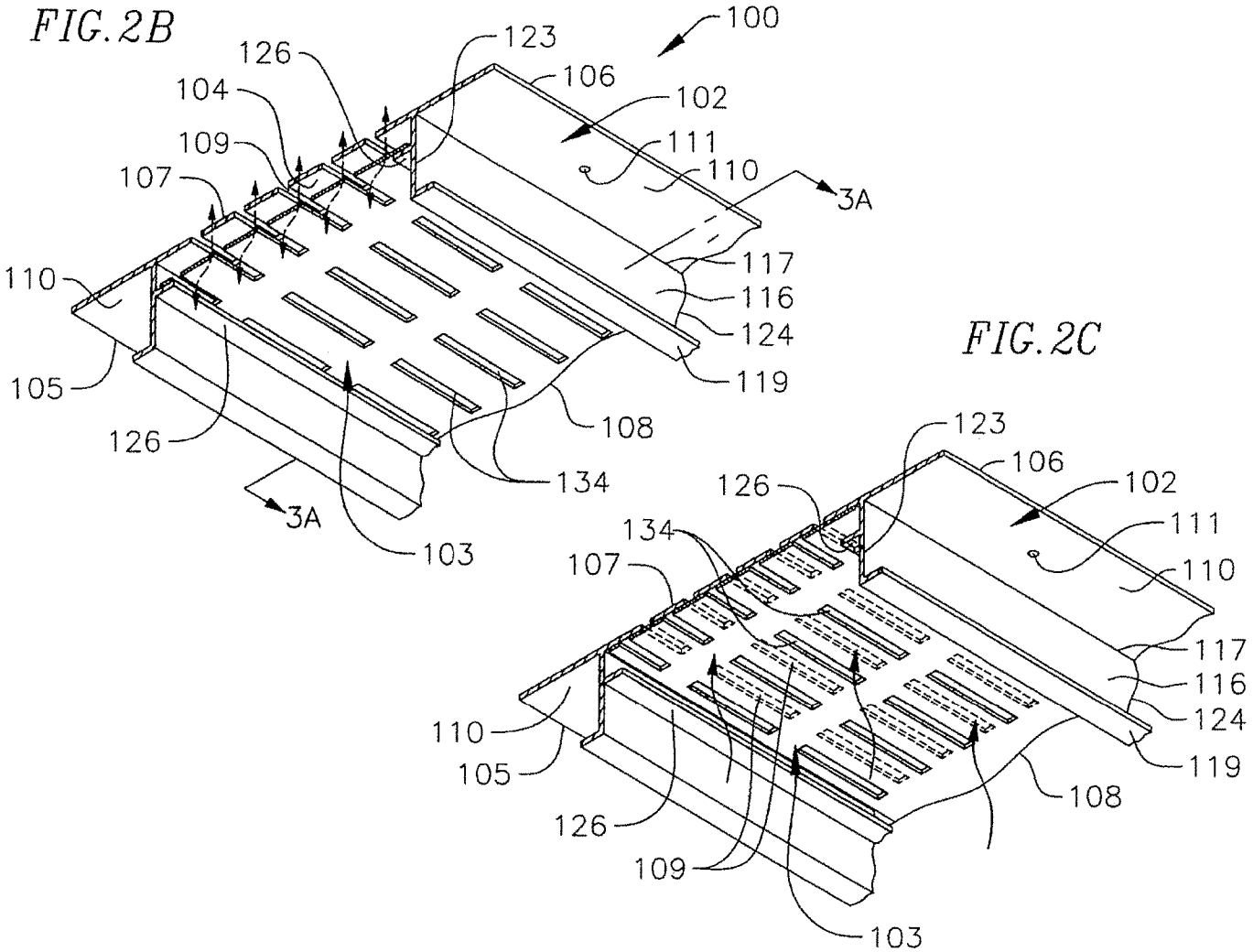
FIGS. 2B and 2C are partial perspective views of the self-closing vent of FIG. 2A shown in an open position and a closed position, respectively.
Figure 2D:
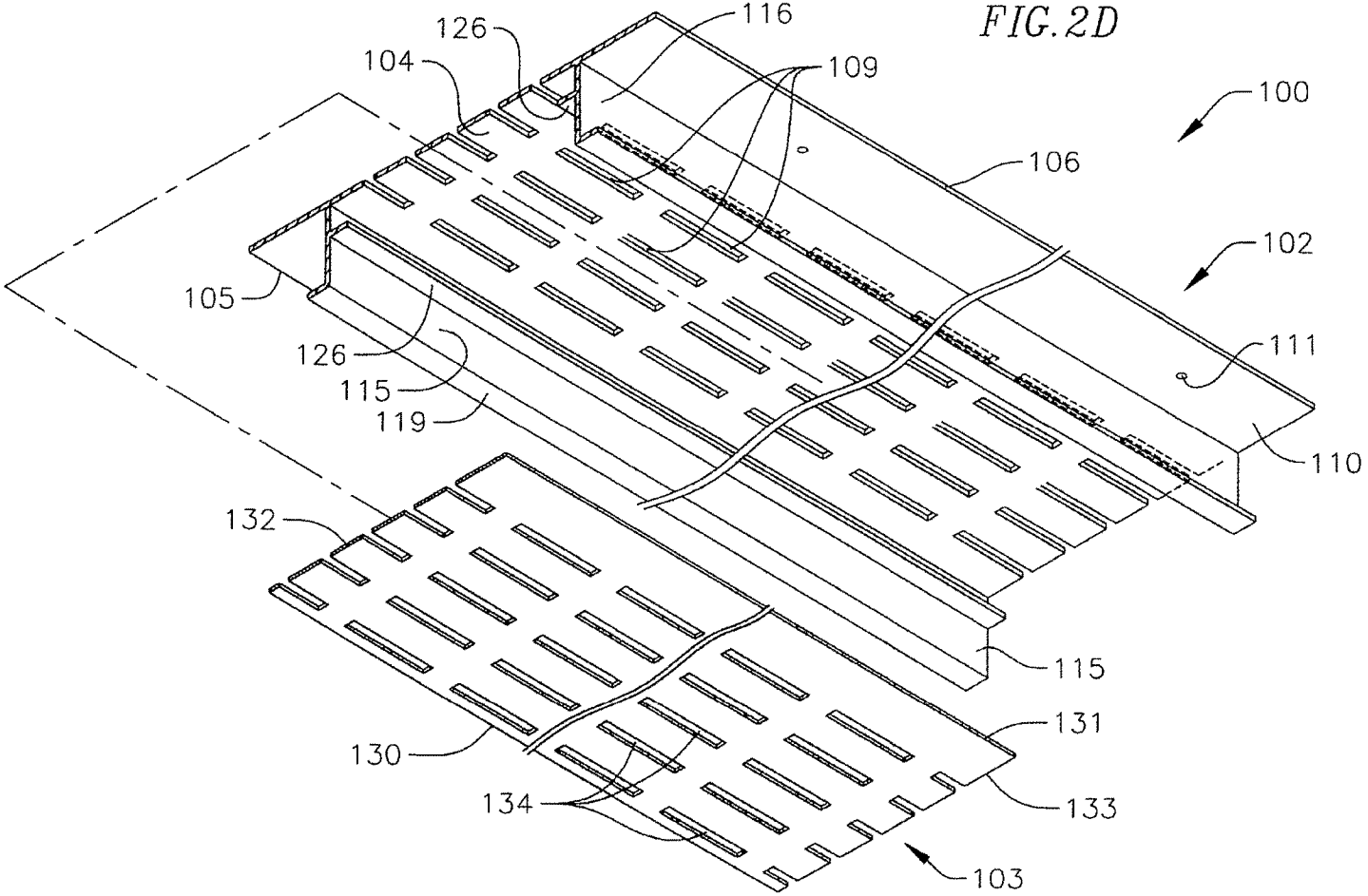
FIG. 2D is an exploded perspective view of the self-closing vent of FIG. 2A.

With continued reference to FIGS. 2A and 2B, the base vent plate 104 also includes a peripheral flange portion 110. In the illustrated embodiment, the peripheral flange 110 is co-planar with the base vent plate 104, although the peripheral flange 110 may be non-planar with the base vent plate 104 and still fall within the scope and spirit of the present disclosure. In one embodiment, the peripheral flange 110 includes a plurality of apertures 111 configured to receive a plurality of fasteners securing the self-closing vent assembly 100 in the soffit 101 (e.g., the fasteners are configured to secure the self-closing vent assembly 100 to structural support members in the attic). The size and shape of the apertures in the peripheral flange 110 may vary depending upon the type of fasteners used to secure the self-closing vent assembly 100 to the building (e.g., the apertures in the peripheral flange may be circular when the fasteners are screws and may be elliptical when the fasteners are wall anchors, such as butterfly anchors).

Figures 3A, 3B:
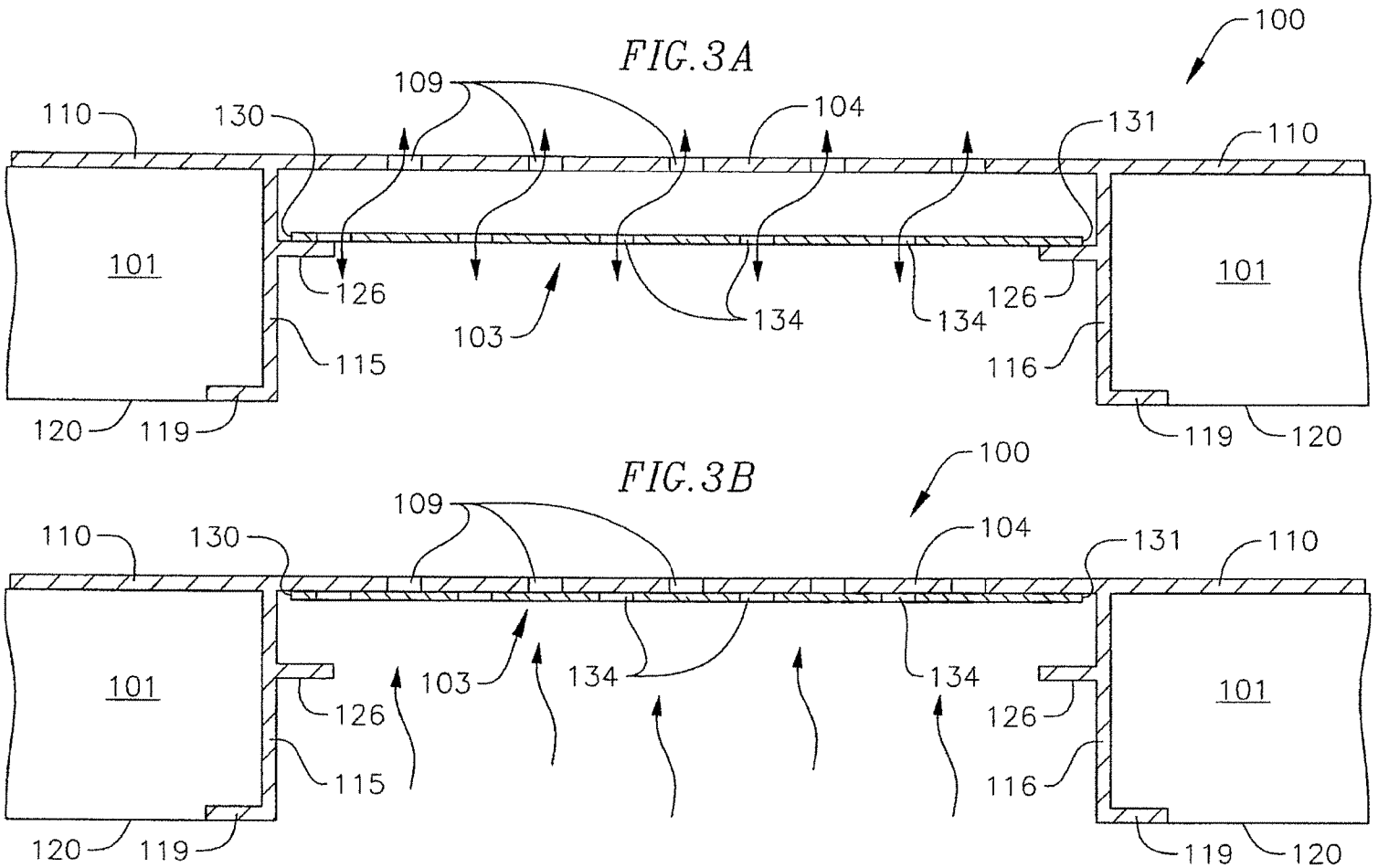
FIGS. 3A and 3B are transverse cross-sectional views of the self-closing vent of FIG. 2A shown in an open position and a closed position, respectively.
Figure 4A:
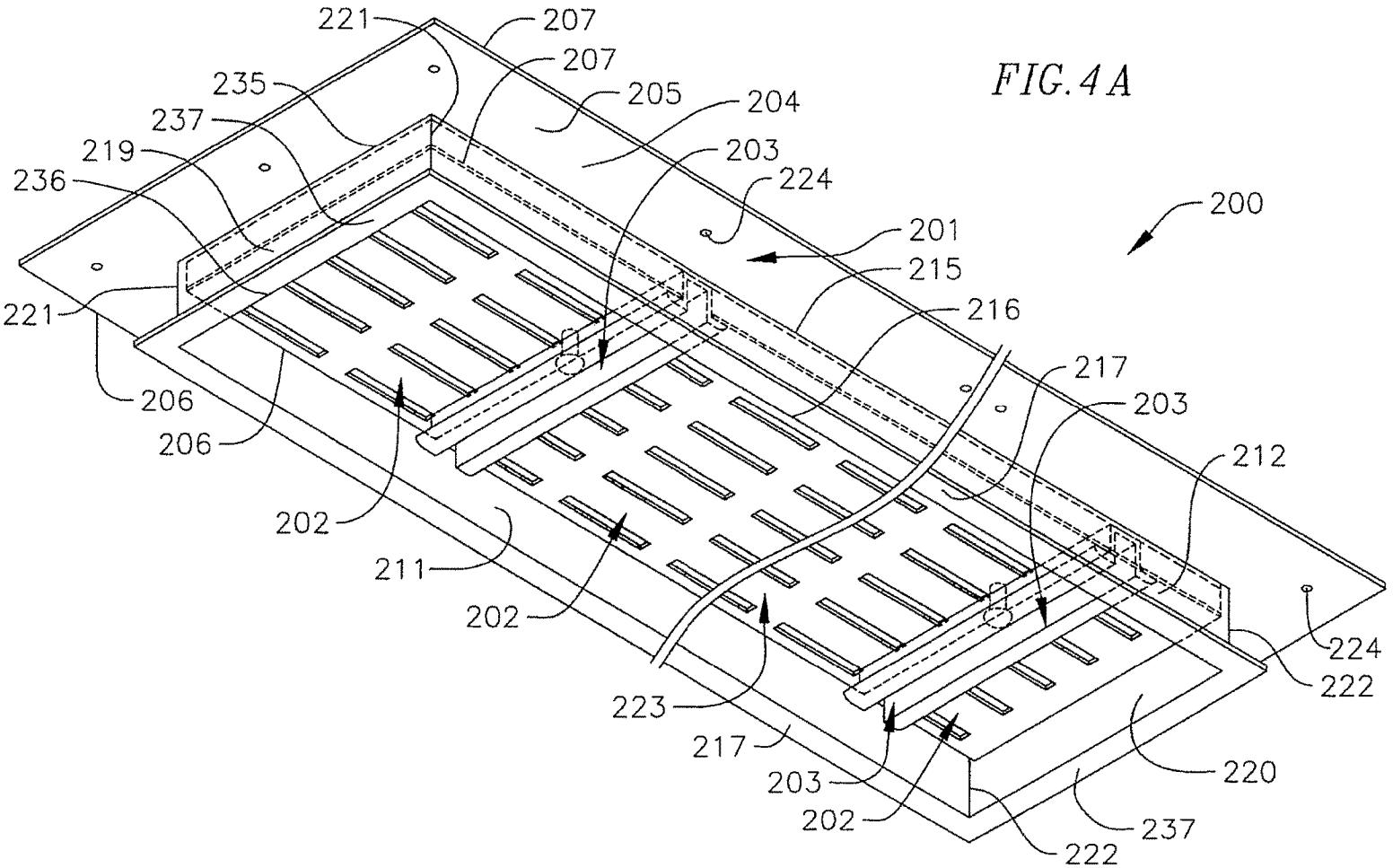
FIG. 4A is a perspective view of a self-closing vent assembly according to another embodiment of the present disclosure.
Figures 4B, 4C:
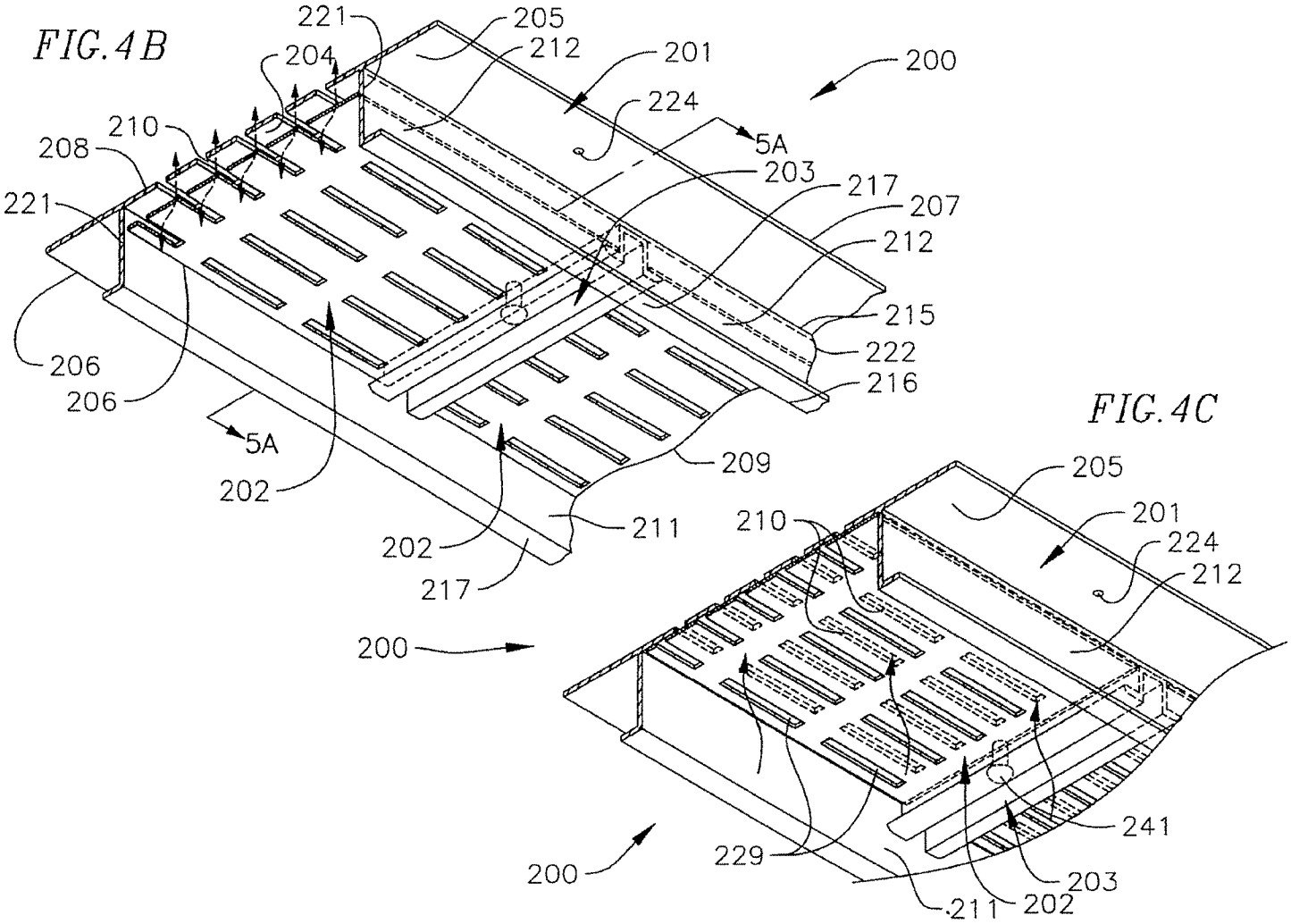
FIGS. 4B and 4C are partial perspective views of the self-closing vent assembly of FIG. 4A shown in an open position and a closed position, respectively.
Figure 4D:
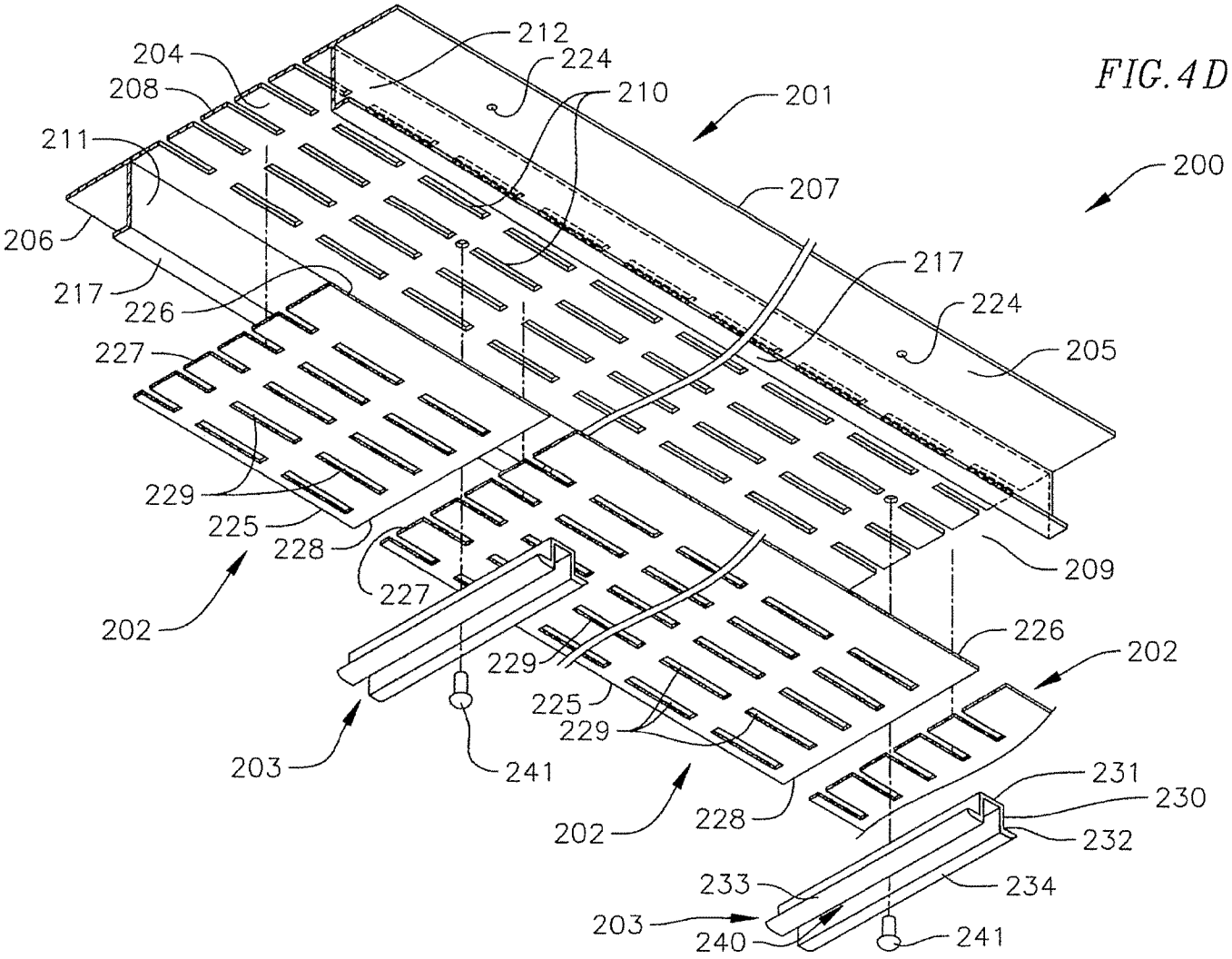
FIG. 4D is an exploded perspective view of the self-closing vent assembly of FIG. 4A.

Still referring to the embodiment illustrated in FIGS. 2A-2D, the base frame 102 includes first and second spaced apart legs 115, 116, respectively, protruding from the base vent plate 104 and extending in the longitudinal direction (i.e., the legs 115, 116 are parallel to the longitudinal edges 105, 106 of the base vent plate 104). Additionally, as illustrated in FIGS. 3A and 3B, the first and second legs 115, 116 are sufficiently tall to extend completely through an opening in the soffit 101 (i.e., the pairs of legs 115, 116 have a height substantially equal to the thickness of the wall member in which the self-closing vent assembly 100 is installed). As used herein, the term "substantially" is used as a term of approximation and not as a term of degree, and is intended to account for the inherent deviations in measured or calculated values that would be recognized by those of ordinary skill in the art. Additionally, each of the longitudinal legs 115, 116 includes an interconnected end 117 coupled to the base vent plate 104 and a free end 118 opposite the interconnected end 117. In the illustrated embodiment, the free ends 118 of the legs 115, 116 include an outwardly projecting flange or lip 119. The outwardly projecting flanges 119 are configured to overhang a portion of the soffit 101, as illustrated in FIGS. 3A and 3B. In one embodiment, the outwardly projecting flanges 119 are generally flush with an outer surface 120 of the soffit 101. The base frame 102 also includes a pair of legs 121, 122 protruding from the base vent plate 104 and extending in the transverse direction (i.e., the legs 121, 122 are parallel to the transverse edges 107, 108 of the base vent plate 104). The transverse legs 121, 122 extend between and interconnect opposite ends 123, 124 of the longitudinal legs 115, 116. The transverse legs 121, 122 each also include an interconnected end 112 coupled to the base vent plate 104, a free end 113 opposite the interconnected end 112, and a flange or lip 114 projecting outward from the free ends 113. Together, the interconnected longitudinal and transverse legs 115, 116 and 121, 122, respectively, define a cavity 125 configured to house the floating vent plate 103. In the illustrated embodiment, the longitudinal and transverse legs 115, 116 and 121, 122, respectively, are positioned on the base vent plate 104 such that the peripheral flange portion 110 of the base vent plate 104 overhangs the longitudinal legs 115, 116 and the transverse legs 121, 122. It will be appreciated, however, that the longitudinal and transverse legs 115, 116 and 121, 122, respectively, may be positioned at any other suitable locations on the base vent plate 104, such as, for example, along the longitudinal edges 105, 106 and the transverse edges 107, 108.

Figure 9:
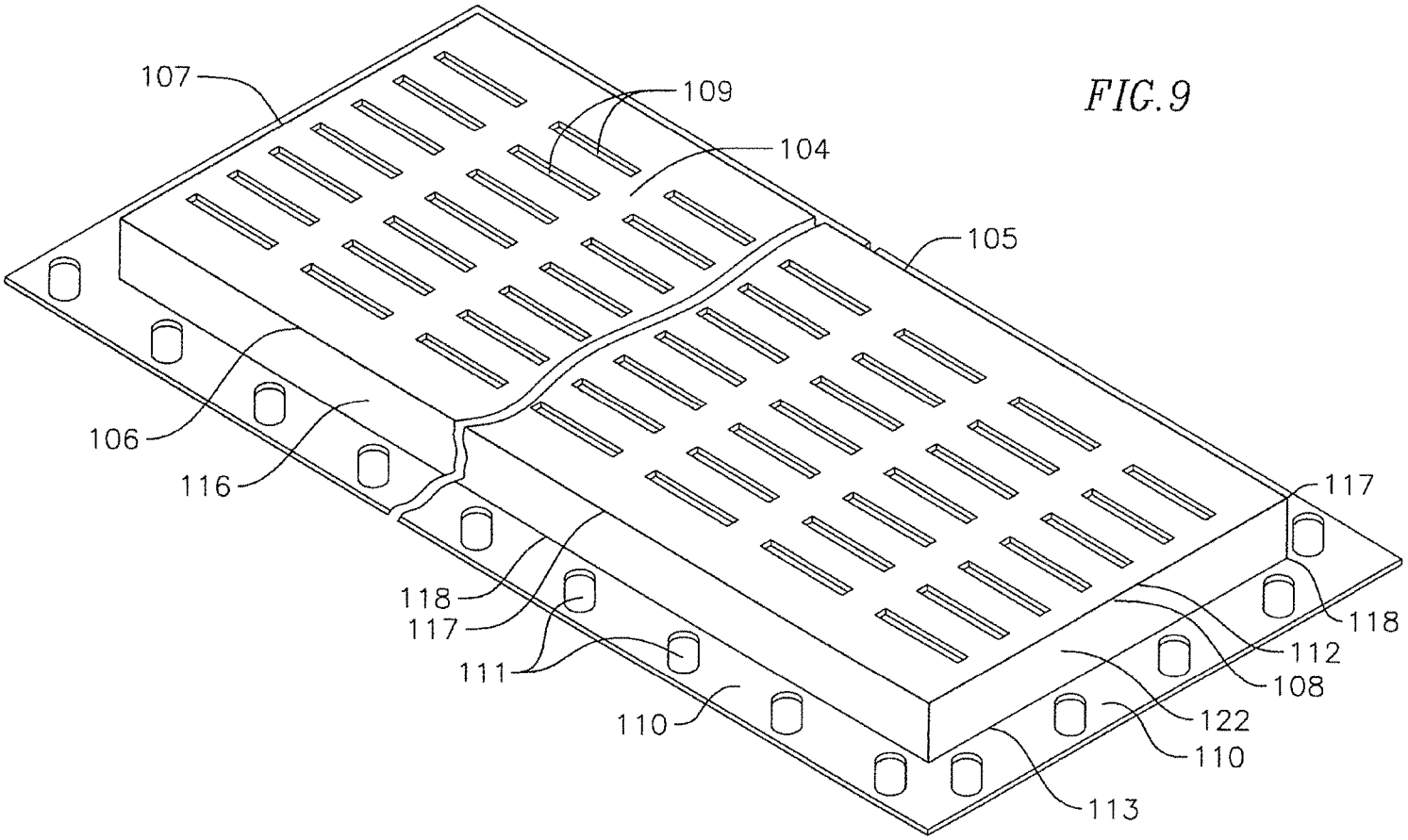
FIG. 9 is a perspective view of a self-closing vent assembly according to another embodiment of the present disclosure.

In an alternate embodiment illustrated in FIG. 9, the flange 110 projects outward from the free ends 118, 113 of the longitudinal legs 115, 116 and the transverse legs 115, 116, respectively, rather than from the base vent plate 104. When the self-closing vent assembly 100 is installed in a soffit 101, the flange 110 is generally flush with an outer surface 120 of the soffit 101. Additionally, in the embodiment illustrated in FIG. 9, the legs 115, 116, 121, 122 extend along the edges 105, 106, 107, 108 of the base vent plate 104. In the illustrated embodiment, the apertures 111 in the flange 110 are oval, such that the apertures 111 may receive wall anchors, such as butterfly anchors. Depending upon the material of the soffit 101, such as, for example, wood or sheetrock, any other suitable type of fasteners may be used to attach the self-closing vent assembly 100 to the soffit 101, such as, for example, drywall screws, and the shape of the apertures 111 in the flange 110 may be selected according to the type of fasteners selected. Additionally, in one or more alternate embodiments, the flange 110 may be provided without the apertures 111.

With reference now to FIGS. 2A-3B, the longitudinal legs 115, 116 each also include an inwardly protruding flange 126. Together, the inwardly protruding flanges 126 define a ledge configured to support the floating vent plate 103 in the open position, as illustrated in FIGS. 2A and 3A. In one embodiment, the inwardly protruding flanges 126 on the longitudinal legs 115, 116 are spaced apart from the base vent plate 104 by approximately ⅛ such that the floating vent plate 103 in the open position is spaced apart from the base vent plate 104 by approximately ⅛ inch. It will be appreciated that floating vent plate 103 in the open position may be spaced apart from the base vent plate 104 by any other suitable distance, such as between approximately 1/16 inch and approximately ½ inch. In another embodiment, the floating vent plate 103 in the open position may be spaced apart from the base vent plate 104 by a greater distance, such as, for example, approximately 1 inch. Accordingly, the vertical movement of the floating vent plate 103 is constrained between the base vent plate 104 and the inwardly protruding flanges 126 on the longitudinal legs 115, 116.

In the illustrated embodiment of FIGS. 2A-3B, the floating vent plate 103 is a rectangular plate having a pair of longer edges 130, 131 extending in a longitudinal direction and a pair of shorter edges 132, 133 extending in a direction transverse to the longer edges 130, 131. It will be appreciated that the floating vent plate 103 may have any other suitable shape, such as square or circular. The floating vent plate 103 also includes a plurality of apertures 134 laterally offset from the apertures 109 in the base vent plate 104 (i.e., the apertures 134 in the floating vent plate 103 are offset from the apertures 109 in the base vent plate 104 in the transverse direction of the self-closing vent assembly 100). In the illustrated embodiment, the apertures 134 in the floating vent plate 103 are a plurality of rectangular openings or slots disposed in a grid-like pattern, although it will be appreciated that the apertures 134 may have any other suitable shaped, such as square or circular, and still fall within the scope and spirit of the present disclosure. In one embodiment, the apertures 134 are rectangular slots having a width of ⅛ inch, a length of 1 inch, and which are spaced apart 1½ inches on-center lengthwise and ½ inch on-center laterally, although the apertures 134 may have any other suitable size and spacing. Additionally, in the illustrated embodiment, the apertures 134 in the floating plate 103 have substantially the same size and shape as the apertures 109 in the base vent plate 104, although the apertures 134 in the floating vent plate 103 may have a different size and/or shape than the apertures 109 in the base vent plate 104 and still fall within the scope and spirit of the present disclosure.

The floating vent plate 103 is configured to move between an open position (FIG. 3A) spaced apart from the base vent plate 104 and a closed position (FIG. 3B) wherein the floating vent plate 103 abuts the base vent plate 104. In the open position, the longitudinal edges 130, 131 of the floating vent plate 103 are supported by the flanges 126 on the longitudinal legs 115, 116 such that the floating plate 103 is spaced apart from the base vent plate 104. Accordingly, in the open position, air is permitted to pass through the self-closing vent assembly 100 (i.e., air is permitted to flow in a serpentine path through the apertures 134 in the floating vent plate 103 and the laterally offset apertures 109 in the base vent plate 104, as illustrated in FIG. 3A). The offset apertures 109, 134 in the base vent plate 104 and the floating vent plate 103, respectively, are also configured to prevent rising embers during a fire from freely passing through the self-closing vent assembly 100 because the rising embers must travel in a serpentine path to pass through the self-closing vent assembly 100 (i.e., because the apertures 109, 134 in the base vent plate 104 and the floating vent plate 103, respectively, are offset, rising embers cannot travel in a direct vertical path and pass through the self-closing vent assembly 100).

During a fire, air velocities can reach upwards of 85 miles per hour ("mph") due to the updraft of the hotter air. In one embodiment, the floating vent plate 103 is configured to move into the closed position (FIG. 3B) when subject to rising hot air having a velocity of at least approximately 37 mph. As used herein, the term "activation velocity" refers to the minimum air velocity at which the floating vent plate 103 is configured to move from the open position and into the closed position. It will be appreciated that the floating vent plate 103 may be configured to move into the closed position (FIG. 3B) when subject to rising air having any desired activation velocity, such as, for example, approximately 25 mph to approximately 75 mph, by selecting the appropriate weight and surface area of the floating vent plate 103 (i.e., the activation velocity at which the floating vent plate 103 is configured to move into the closed position may be controlled by selecting the appropriate shape, size, and/or material of the floating vent plate 103). For instance, in one example embodiment in which the floating vent plate 103 is approximately 2 inches wide (i.e., the distance between the first and second longer edges 105, 106 is approximately 2 inches), approximately 12 inches long (i.e., the distance between the first and second shorter edges 107, 108 is approximately 12 inches), approximately 1/25 inch thick, and is composed of aluminum, the activation velocity is approximately 25 mph. In an embodiment in which the floating vent plate 103 is approximately 3 inches wide, approximately 12 inches long, approximately 1/25 inch thick, and is composed of aluminum, the activation velocity is approximately 30 mph. In an embodiment in which the floating vent plate 103 is approximately 4 inches wide, approximately 12 inches long, approximately 1/25 inch thick, and is composed of aluminum, the activation velocity is approximately 35 mph. In the closed position, the floating vent plate 103 abuts the base vent plate 104. Accordingly, in the closed position, the self-closing vent assembly 100 is configured to prevent both air and rising embers from passing through the vent (i.e., the abutment between the floating vent plate 103 and the base vent plate 104 and the offset apertures 109, 134 are configured to prevent both air and rising embers from passing through the self-closing vent assembly 100). Said another way, when the floating vent plate 103 is in the closed position, the flow of air and/or rising embers are obstructed or substantially obstructed from passing through the laterally offset apertures 109, 134 in the base vent plate 104 and the floating vent plate 103, respectively (i.e., in the closed position, the self-closing vent assembly 100 is configured to prevent the flow of air and embers through both sets of apertures 109, 134 simultaneously in a direction perpendicular to an imaginary plane extending through the plane of the apertures 134 in the floating vent plate 104). Such perpendicular flow through the apertures 109, 134 will be prevented by the solid portions of the base vent plate 104 that cover the apertures 134 in the floating vent plate 104, as illustrated in FIG. 3B.

With reference now to FIGS. 4A-4D, another embodiment of a self-closing vent assembly 200 is illustrated. Unlike the self-closing vent assembly 100 described above, the self-closing vent assembly 200 illustrated in FIGS. 4A-4D is a retrofit of an existing ventilation assembly. The self-closing vent assembly 200 includes an existing base frame 201 and a plurality of floating vent plates 202 movedly retained to the existing base frame 201 by a plurality of transverse supports 203. The existing base frame 201 includes a base vent plate 204. In the illustrated embodiment, the base vent plate 204 is a rectangular plate having a pair of longer edges 206, 207 extending in a longitudinal direction and a pair of shorter edges 208, 209 extending in a direction transverse to the longer edges 206, 207. It will be appreciated that the base vent plate 204 may have any other suitable shape, such as square or circular. The base vent plate 204 also includes a plurality of apertures 210. In the illustrated embodiment, the apertures 210 are rectangular openings or slots disposed in a grid-like pattern, although it will be appreciated that the apertures 210 may have any other suitable shape, such as square or circular, and still fall within the scope and spirit of the present disclosure. In one embodiment, the apertures 210 are rectangular slots having a width of 1/8 inch, a length of 1 inch, and which are spaced apart 1½ inches on-center lengthwise and ½ inch on-center laterally, although the apertures 210 may have any other suitable size and spacing.

With continued reference to FIGS. 4A-4D, the base vent plate 204 also includes a peripheral flange portion 205. In the illustrated embodiment, the peripheral flange 205 is co-planar with the base vent plate 204, although the peripheral flange 205 may be non-planar with the base vent plate 204 and still fall within the scope and spirit of the present disclosure. In one embodiment, the peripheral flange 205 may include a plurality of apertures 224 configured to receive a plurality of fasteners securing the self-closing vent assembly 200 in a soffit 214 (e.g., the fasteners may be configured to secure the self-closing vent assembly 200 to structural support members in an attic). The size and shape of the apertures 224 in the peripheral flange 205 may vary depending upon the type of fasteners used to secure the self-closing vent assembly 200 in the soffit 214 (e.g., the apertures 224 in the peripheral flange 205 may be circular when the fasteners are screws and may be ovaloid when the fasteners are wall anchors, such as butterfly anchors).

Figures 5A, 5B:
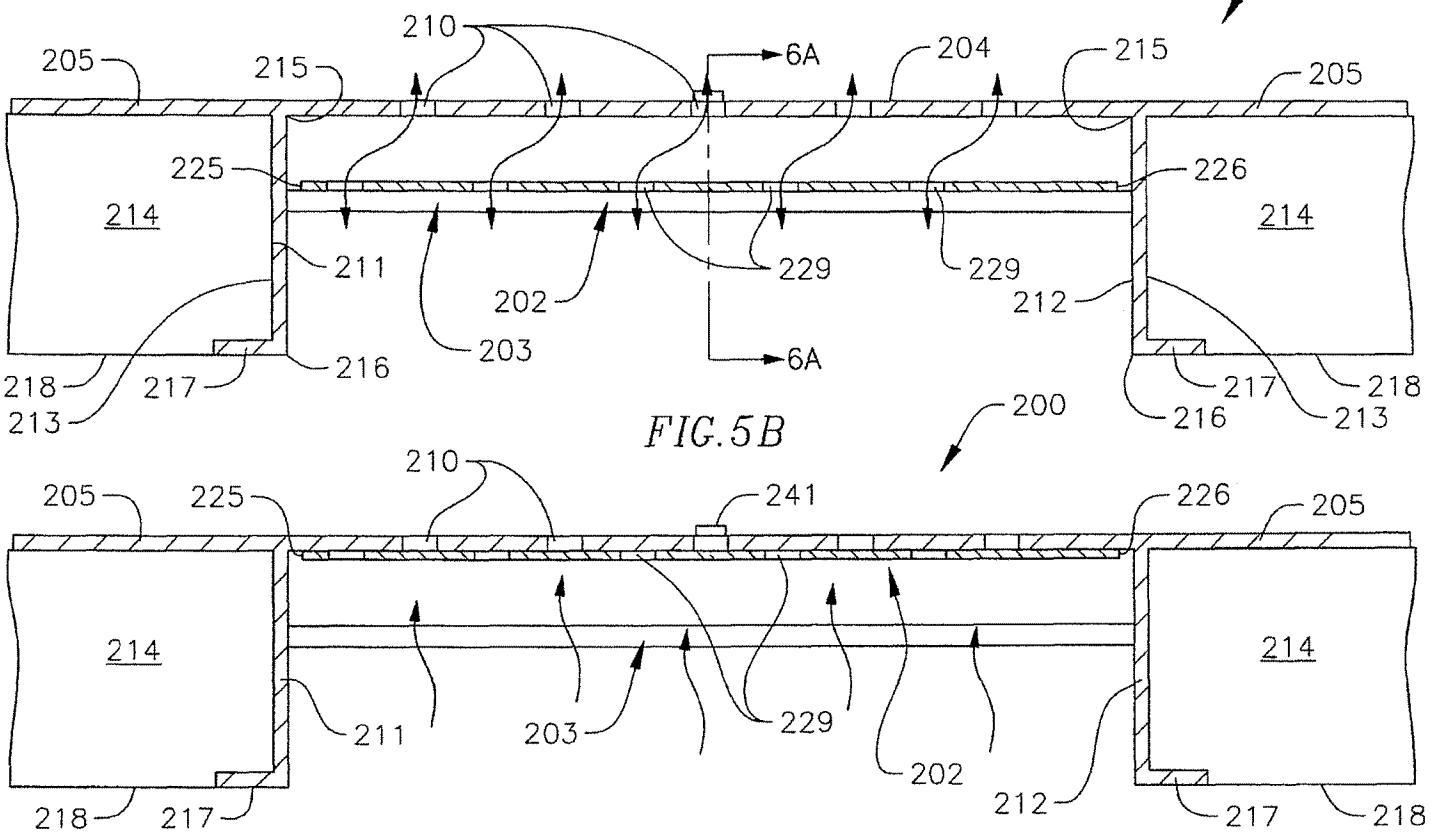
FIGS. 5A and 5B are transverse cross-sectional views of the self-closing vent assembly of FIG. 4A shown in an open position and a closed position, respectively.

Still referring to the embodiment illustrated in FIGS. 4A-4D, the existing base frame 201 includes a pair of spaced apart legs 211, 212 protruding from the base vent plate 204 and extending in the longitudinal direction. In the illustrated embodiment, the longitudinal legs 211, 212 are spaced apart from the longitudinal edges 206, 207 of the base vent plate 204 such that at least a portion of the peripheral flange portion 205 overhangs the legs 211, 212. Additionally, in the illustrated embodiment, the pair of legs 211, 212 is sufficiently tall to extend completely through an opening 213 in the soffit 214 or other wall member in which self-closing vent assembly 200 is installed, as illustrated in FIGS. 5A and 5B. Additionally, each of the legs 211, 212 includes an interconnected end 215 coupled to the base vent plate 204 and a free end 216 opposite the interconnected end 215. In the illustrated embodiment, the free ends 216 of the legs 211, 212 include an outwardly projecting flange 217. The outwardly projecting flanges 217 are configured to overhang a portion of the soffit 214 or other wall member in which the self-closing vent assembly 200 is installed, as illustrated in FIGS. 5A and 5B. In one embodiment, the outwardly projecting flanges 217 are generally flush with an outer surface 218 of the soffit 214. In an alternate embodiment, the existing base frame 201 may be provided without the flanges 217. The existing base frame 201 also includes a pair of legs 219, 220 protruding from the base vent plate 204 and extending in the transverse direction. The transverse legs 219, 220 also include an interconnected end 235 coupled to the base vent plate 204, a free end 236 opposite the interconnected end 235, and a flange 237 projecting outward from the free end 235. The transverse legs 219, 220 extend between and interconnect ends 221 of the longitudinal legs 211, 212 and opposite ends 222 of the longitudinal legs 211, 212, respectively. Together, the longitudinal and transverse legs 211, 212 and 219, 220 define a cavity 223 configured to house the plurality of floating vent plates 202 and the plurality of transverse supports 203. In an alternate embodiment, the flange 205 may be positioned in substantially the same position as flange 110 illustrated in FIG. 9 and described above (i.e., the flange 205 may extend outward from the free ends 216, 236 of the longitudinal legs 211, 212 and the transverse legs 219, 220, respectively, rather than from the base vent plate 204, such that when the self-closing vent assembly 200 is installed in a soffit 214, the flange 205 is generally flush with the outer surface 218 of the soffit 214.

In the illustrated embodiment of FIGS. 4A-4D, each of the floating vent plates 202 is a rectangular plate having a pair of longer edges 225, 226 extending in a longitudinal direction and a pair of shorter edges 227, 228 extending in a direction transverse to the longer edges 225, 226. It will be appreciated that the floating vent plates 202 may have any other suitable shape, such as square or circular. The floating vent plates 202 each also include a plurality of apertures 229 laterally offset from the apertures 210 in the base vent plate 204 (i.e., the apertures 229 in the floating vent plates 202 are offset from the apertures 210 in the base vent plate 204 in the transverse direction of the self-closing vent assembly 200). In the illustrated embodiment, the apertures 229 in the floating vent plates 202 are rectangular openings or slots disposed in a grid-like pattern, although it will be appreciated that the apertures 229 may have any other suitable shape, such as square or circular, and still fall within the scope and spirit of the present disclosure. In one embodiment, the length of each floating vent plate 202 is approximately 12 inches, although the floating vent plates 202 may have any other suitable length, such as approximately 6 inches to approximately 120 inches.

Figure 6A:
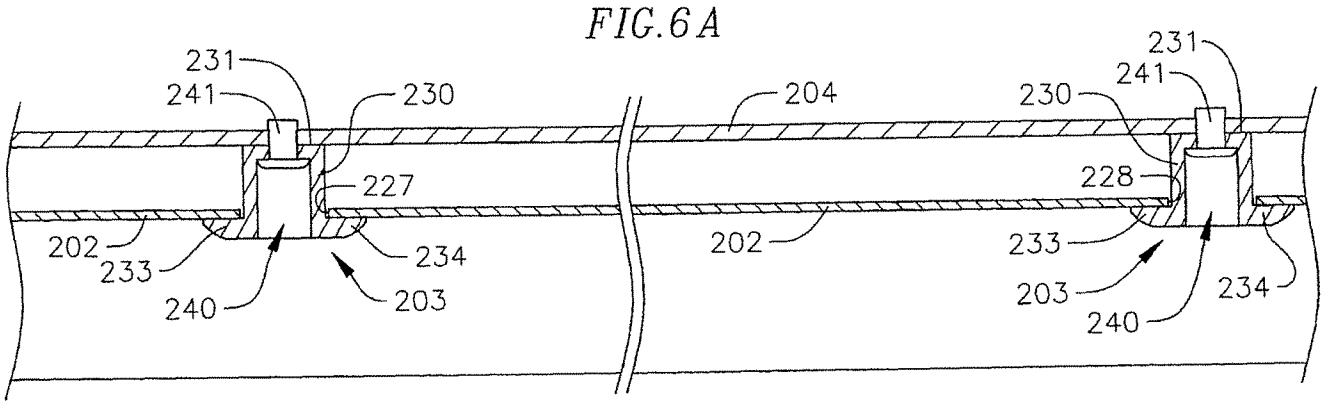
FIGS. 6A and 6B are longitudinal cross-sectional views of the self-closing vent assembly of FIG. 4A shown in an open position and a closed position, respectively.

With continued reference to FIGS. 4A-4D, the lateral supports 203, which are configured to support the transverse edges 227, 228 of the floating plates 202 when the floating plates 202 are in an open position, are spaced apart by a distance corresponding to the length of the floating vent plates 202. Each transverse support 203 includes a rectangular standoff 230 having an interface end 231 configured to abut the base vent plate 204 and a free end 232 opposite the interface end 231. Each transverse support 203 also includes a pair of opposing lips 233, 234 extending outward from the free end 232 of the transverse support 203. When the transverse supports 203 are coupled to the existing base frame 201, the lips 233, 234 are configured to extend in a transverse direction between the longitudinal legs 211, 212 on the existing base frame 201. As illustrated in FIGS. 4A-4D, each support 203 is generally T-shaped in longitudinal cross-section. Pairs of adjacent supports 203 are configured to support opposite transverse edges 227, 228 of each floating vent plate 202 (i.e., together, one of the lips 233 on one of the supports 203 and one of the lips 234 on an adjacent support 203 define a ledge configured to support the transverse edges 227, 228 of the floating vent plates 202 in the open position, as illustrated in FIG. 6A). In one embodiment, the standoffs 230 on the supports 203 are configured to space the lips 233, 234 apart from the base vent plate 204 by approximately ⅛ such that the floating vent plates 202 in the open position are spaced apart from the base vent plate 204 by approximately ⅛ inch, as illustrated in FIGS. 5A and 6A. It will be appreciated that floating vent plates 202 in the open position may be spaced apart from the base vent plate 204 by any other suitable distance, such as between approximately 1/16 inch and approximately ½ inch or more. Additionally, although the lateral supports 203 are illustrated having a generally T-shaped longitudinal cross-section, it will be appreciated that the lateral supports 203 may have any other suitable shape, such as, for instance, a Z-shaped, L-shaped, or S-Shaped longitudinal cross-section and still fall within the scope and spirit of the present disclosure.

With continued reference to the embodiment illustrated in FIGS. 4A-4D, each support 203 includes a depression 240 configured to receive or recess at least one fastener 241 coupling the support 203 to the base vent plate 204. In the illustrated embodiment, the depression 240 is a rectangular channel disposed between the lips 233, 234 and extending in a transverse direction. It will be appreciated that the depression 240 may have any other suitable shape, such as circular, and still fall within the scope and spirit of the present disclosure.

Figure 6B:
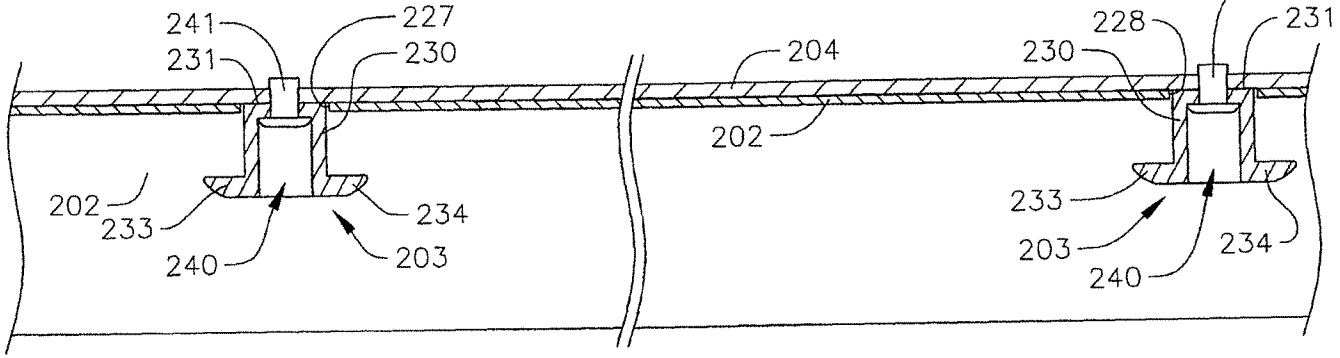

The floating vent plates 202 are configured to move between an open position (FIGS. 4A, 4B, 5A, and 6A) spaced apart from the base vent plate 204 and a closed position (FIGS. 4C, 5B, and 6B) wherein the floating vent plates 202 abut the base vent plate 204. In the open position, the transverse edges 227, 228 of the floating vent plates 202 are supported by the lips 233, 234 on the supports 203 such that the floating plates 202 are spaced apart from the base vent plate 204 by a distance, such as, for example, between approximately 1/16 inch and approximately ½ inch. In one embodiment, the floating plates 202 in the open position are spaced apart from the base vent plate 204 by approximately ⅛ inch. Accordingly, in the open position, air is permitted to pass through the self-closing vent assembly 200 by flowing in a serpentine path through the apertures 229 in the floating vent plates 202 and the offset apertures 210 in the base vent plate 204. The offset apertures 210, 229 in the base vent plate 204 and the floating vent plates 202, respectively, are also configured to prevent rising embers from freely passing through the self-closing vent assembly 200 because the rising embers must travel in a serpentine path to pass through the self-closing vent assembly 200 (i.e., because the apertures 210, 229 in the base vent plate 204 and the floating vent plates 202, respectively, are offset, rising embers cannot travel in a direct vertical path and pass through the self-closing vent assembly 200).

During a fire, air velocities can reach upwards of 85 miles per hour ("mph") due to the updraft of the hotter air. In one embodiment, the floating vent plates 202 are configured to move into the closed position (FIGS. 4B, 5B, and 6B) when subject to rising hot air having a velocity of at least approximately 37 mph. It will be appreciated, however, that the floating vent plates 202 may be configured to move into the closed position when subject to rising air having any other desired activation velocity, such as, for example, between approximately 25 mph and approximately 75 mph, by selecting the appropriate weight and surface area of the floating vent plates 202. As described above with reference to self-closing vent assembly 100 and floating plate 103, the activation velocity at which the floating vent plates 202 are configured to move into the closed position may be controlled by selecting the appropriate shape, size, and/or material of the floating vent plates 202. For instance, in one example embodiment in which the floating vent plates 202 are approximately 2 inches wide, approximately 12 inches long, approximately 1/25 inch thick, and are composed of aluminum, the activation velocity is approximately 25 mph. In an embodiment in which the floating vent plates 202 are approximately 3 inches wide, approximately 12 inches long, approximately 1/25 inch thick, and are composed of aluminum, the activation velocity is approximately 30 mph. In an embodiment in which the floating vent plates 202 are approximately 4 inches wide, approximately 12 inches long, approximately 1/25 inch thick, and are composed of aluminum, the activation velocity is approximately 35 mph.

In the closed position, the floating vent plates 202 abut the base vent plate 204. Accordingly, in the closed position, the self-closing vent assembly 200 is configured to prevent both air and rising embers from passing through the vent (i.e., the abutment between the floating vent plates 202 and the base vent plate 204 and the offset apertures 210, 229 are configured to prevent both air and rising embers from passing through the self-closing vent assembly 200). That is, in the closed position, the self-closing vent assembly 200 is configured to prevent the flow of air and embers through both sets of apertures 210, 229 simultaneously in a direction perpendicular to an imaginary plane extending through the plane of the apertures 229 in the floating vent plates 202. Such perpendicular flow through the apertures 210, 229 will be prevented by the solid portions of the base vent plate 204 that cover the apertures 229 in the floating vent plates 202, as illustrated in FIG. 5B.

With reference now to FIGS. 7A-7D, another embodiment of a self-closing vent assembly 300 is illustrated. In one embodiment, the self-closing vent assembly 300 is approximately 24 inches long. It will be appreciated, however, that the length of the self-closing vent assembly 300 is not limited to the length recited above, and the self-closing vent assembly 300 may be any other suitable length, such as between approximately 10 inches and 120 inches or more, depending upon the desired ventilation. The self-closing vent assembly 300 includes a base frame 301 and a slidable vent assembly 302 configured to slide between an open position (FIGS. 7A, 7B, 8A, and 8C, during normal ambient conditions, and a closed position (FIGS. 7C, 8B, and 8D) during a fire.

In the illustrated embodiment of FIGS. 7A-7D, the base frame 301 includes a base vent plate 303 having a plurality of apertures 304. In one embodiment, the base vent plate 303 is a rectangular plate having a pair of longer edges 305, 306 extending in a longitudinal direction and a pair of shorter edges 307, 308 extending in a direction transverse to the longer edges 305, 306. It will be appreciated that the base vent plate 303 may have any other suitable shape, such as square or circular. In the illustrated embodiment, the apertures 304 in the base vent plate 303 are rectangular openings or slots disposed in a grid-like pattern, although it will be appreciated that the apertures 304 may have any other suitable shape, such as square or circular, and still fall within the scope and spirit of the present disclosure. In one embodiment, the apertures 304 are rectangular slots having a width of 1/8 inch, a length of 1 inch, and which are spaced apart 1 1/2 inches on-center lengthwise and 1/2 inch on-center laterally, although the apertures 304 may have any other suitable size and spacing.

With reference to FIGS. 7A-8B, the base vent plate 303 also includes a peripheral flange portion 307. In the illustrated embodiment, the peripheral flange 307 is co-planar with the base vent plate 303, although the peripheral flange 307 may be non-planar with the base vent plate 303 and still fall within the scope and spirit of the present disclosure. In one embodiment, the peripheral flange 307 may include a plurality of apertures 324 configured to receive a plurality of fasteners securing the self-closing vent assembly 300 in a soffit 308 (e.g., the fasteners may be configured to secure the self-closing vent assembly 300 to structural support members in the attic). The size and shape of the apertures in the peripheral flange 307 may vary depending upon the type of fasteners used to secure the self-closing vent assembly 300 in the soffit 308 (e.g., the apertures in the peripheral flange may be circular when the fasteners are screws and may be ovaloid when the fasteners are wall anchors, such as butterfly anchors).

Figure 7A:
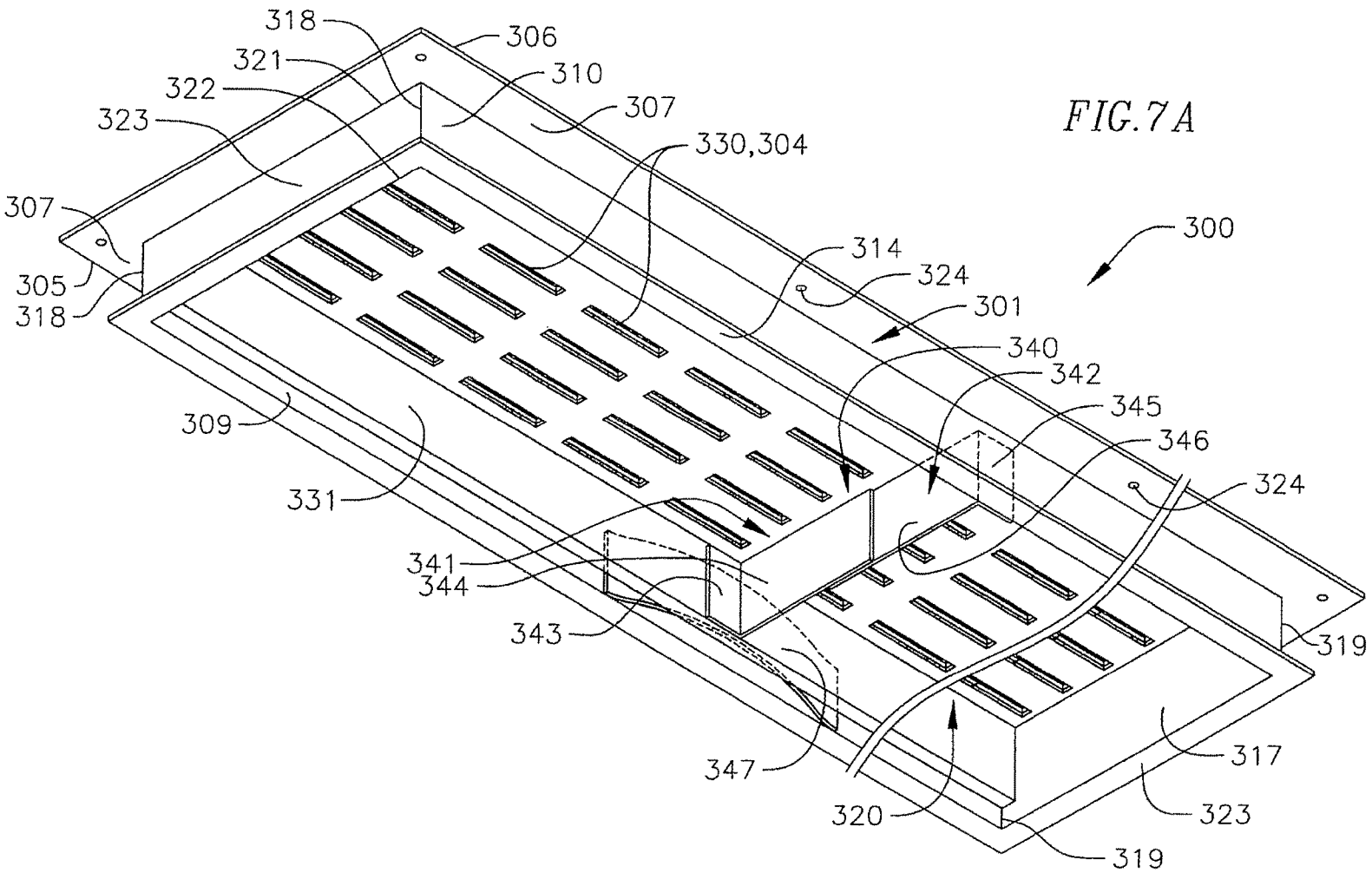
FIG. 7A is a perspective view of a self-closing vent assembly according to another embodiment of the present disclosure.
Figure 7B:
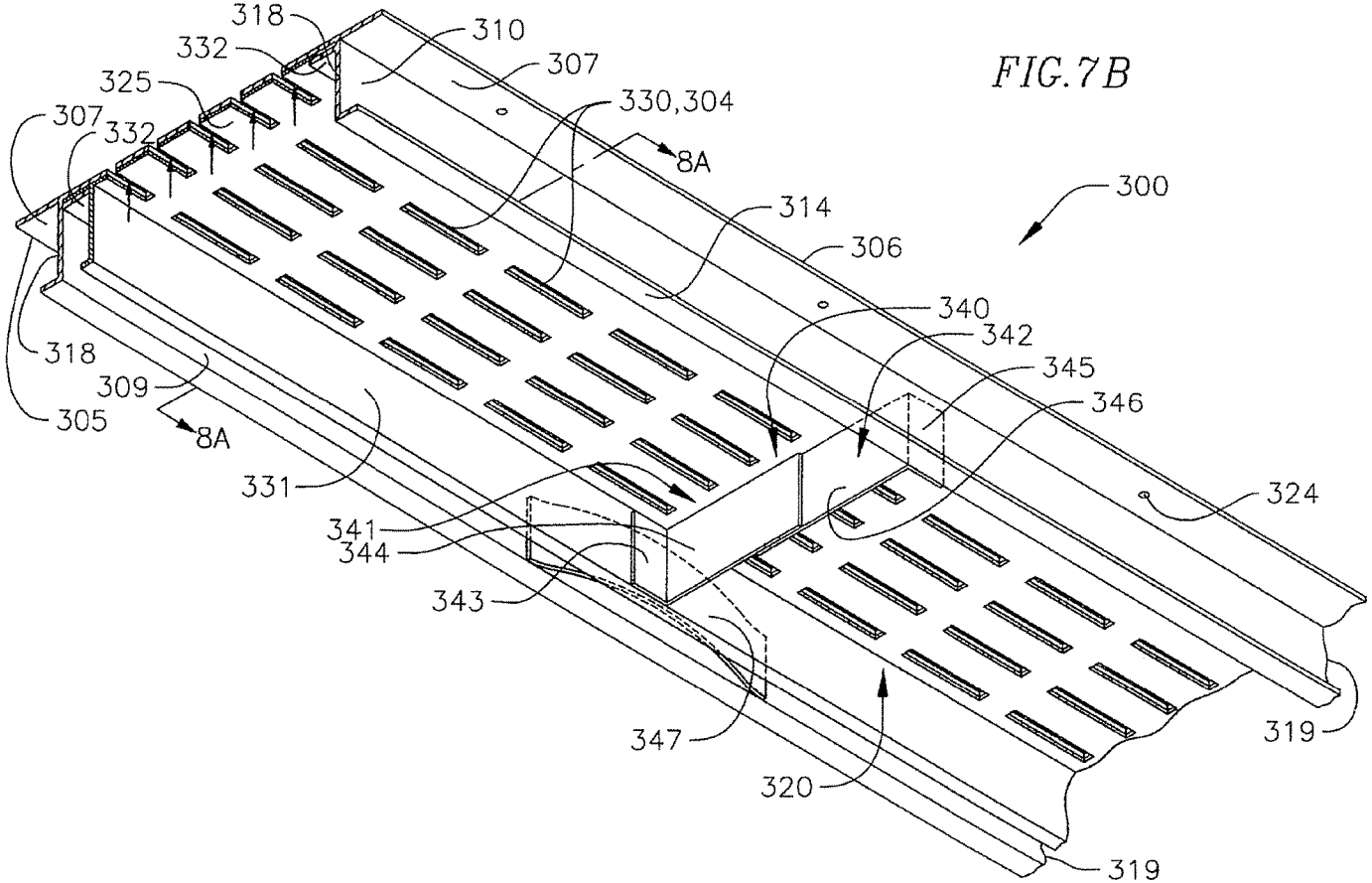
FIGS. 7B and 7C are partial perspective views of the self-closing vent assembly of FIG. 7A shown in an open position and a closed position, respectively.
Figure 7C:
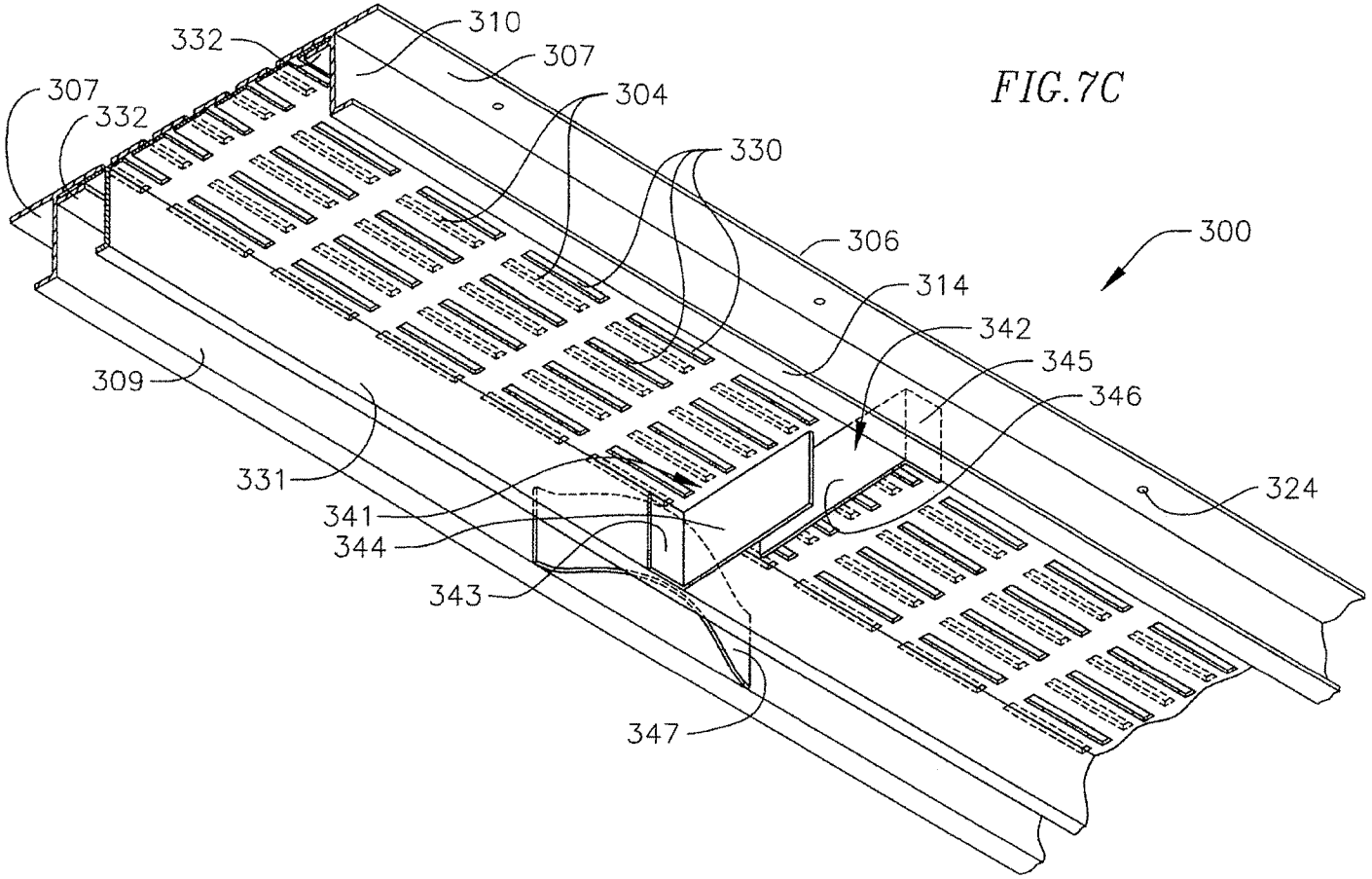
Figure 7D:
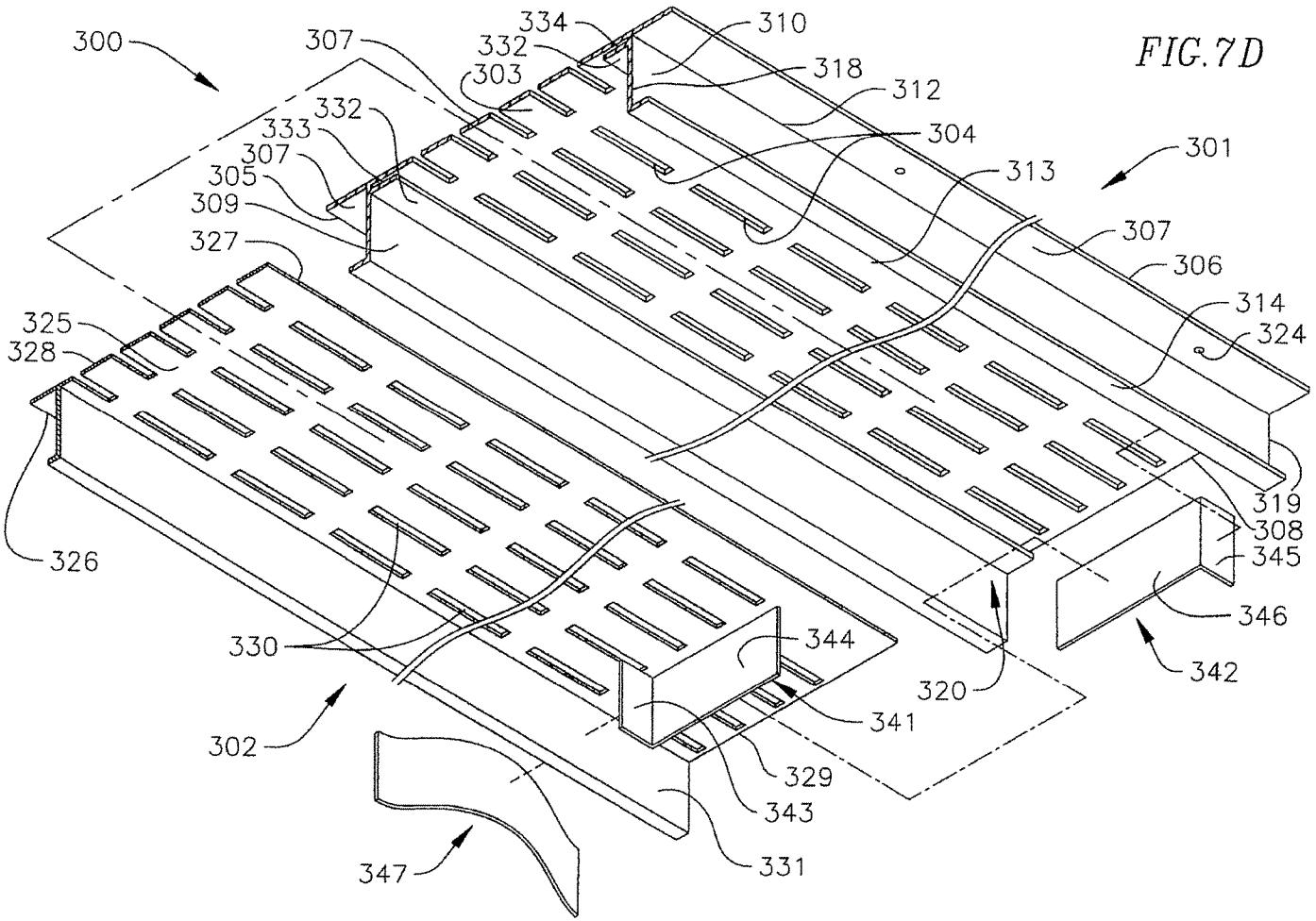
FIG. 7D is an exploded perspective view of the self-closing vent assembly of FIG. 7A.
Figure 8A:
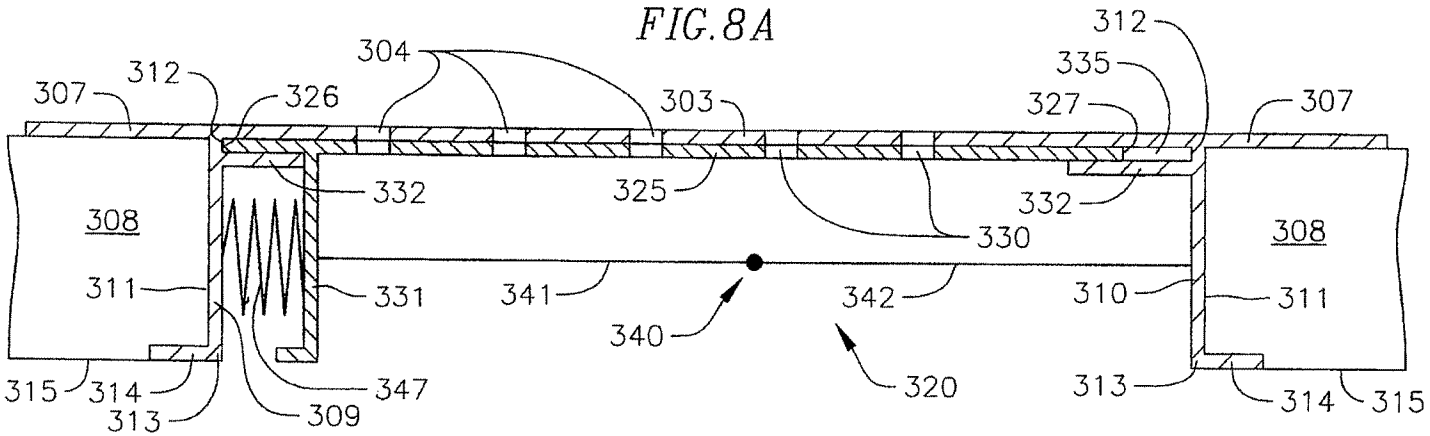
FIGS. 8A and 8B are transverse cross-sectional views of the self-closing vent assembly of FIG. 7A shown in an open position and a closed position, respectively.
Figure 8B:
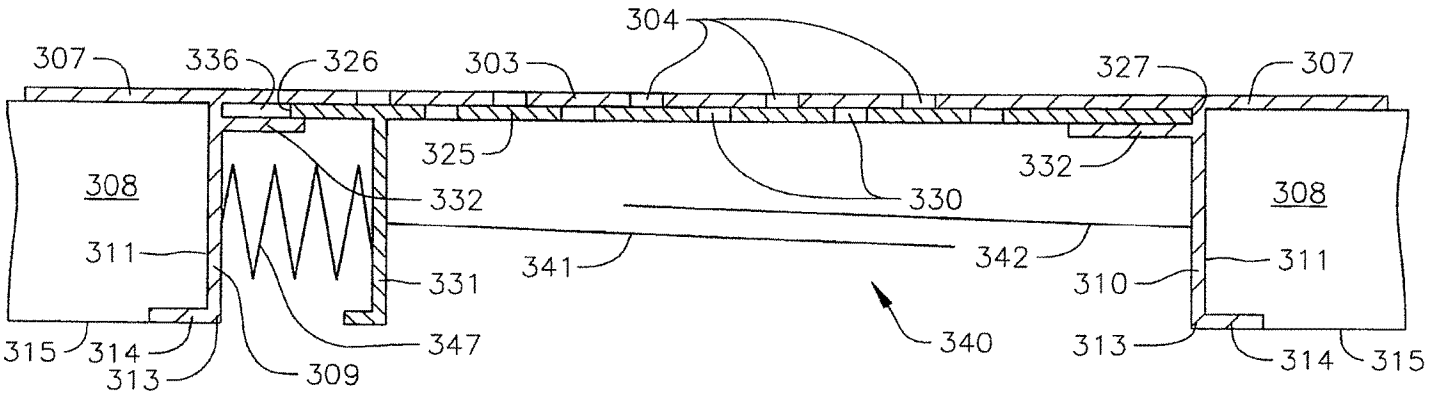
Figure 8C:
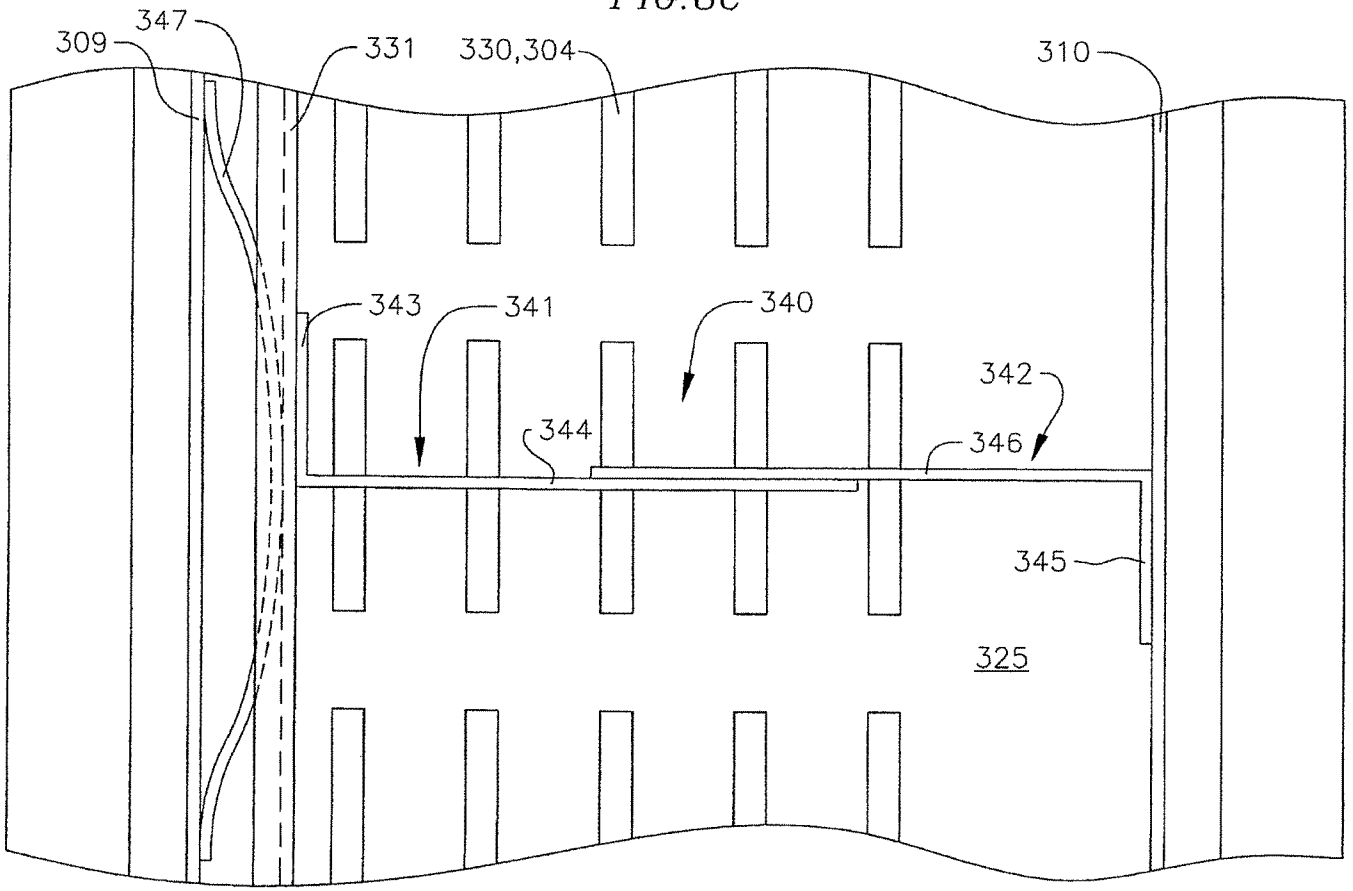
FIGS. 8C and 8D are enlarged bottom views of the self-closing vent assembly of FIG. 7A shown in an open position and a closed position, respectively.

Still referring to the embodiment illustrated in FIGS. 7A-8B, the base frame 301 includes a pair of spaced apart legs 309, 310 protruding from the base vent plate 303 and extending in the longitudinal direction. In the illustrated embodiment, the longitudinal legs 309, 310 are spaced apart from the longitudinal edges 305, 306 of the base vent plate 303 such that at least a portion of the peripheral flange portion 307 overhangs the legs 309, 310. In the illustrated embodiment, the pair of legs 309, 310 is sufficiently tall to extend completely through an opening 311 in the soffit 308 or other wall member in which self-closing vent assembly 300 is installed, as illustrated in FIGS. 8A and 8B. Additionally, each of the legs 309, 310 includes an interconnected end 312 coupled to the base vent plate 303 and a free end 313 opposite the interconnected end 312. In the illustrated embodiment, the free ends 313 of the legs 309, 310 include an outwardly projecting flange 314. The outwardly projecting flanges 314 are configured to overhang a portion of the soffit 308 when the self-closing vent assembly 300 is installed, as illustrated in FIGS. 8A and 8B. In one embodiment, the outwardly projecting flanges 314 are generally flush with an outer surface 315 of the soffit 308. In an alternate embodiment, the base frame 301 may be provided without the flanges 314. As illustrated in FIG. 7A, the base frame 301 also includes a pair of legs 316, 317 protruding from the base vent plate 303 and extending in the transverse direction. The transverse legs 316, 317 extend between and interconnect ends 318 of the longitudinal legs 309, 310 and opposite ends 319 of the longitudinal legs 309, 310, respectively. The transverse legs 316, 317 also include an interconnected end 321 coupled to the base vent plate 303, a free end 322 opposite the interconnected end 321, and a flange 323 projecting outward from the free end 322. Together, the longitudinal and transverse legs 309, 310 and 316, 317 define a cavity 320 configured to house the slidable vent assembly 302.

In the illustrated embodiment of FIGS. 7A-8B, the slidable vent assembly 302 includes a slidable vent plate 325. As illustrated in FIG. 7D, the slidable vent plate 325 is a rectangular plate having a pair of longer edges 326, 327 extending in a longitudinal direction and a pair of shorter edges 328, 329 extending in a direction transverse to the longer edges 326, 327. It will be appreciated that the slidable vent plate 325 may have any other suitable shape, such as square or circular. The slidable vent plate 325 also includes a plurality of apertures 330. In the illustrated embodiment, the apertures 330 in the slidable vent plate 325 are rectangular openings or slots disposed in a grid-like pattern, although it will be appreciated that the apertures 330 may have any other suitable shape, such as square or circular, and still fall within the scope and spirit of the present disclosure. In one embodiment, the apertures 330 in the slidable vent plate 325 have substantially the same size and shape as the apertures 304 in the base vent plate 303, although it will be appreciated that the apertures 330 in the slidable vent plate 325 may have a different size and/or shape than the apertures 304 in the base vent plate 303.

With continued reference to FIGS. 7A-8B, the slidable vent assembly 302 also includes a stiffening leg 331 protruding from slidable vent plate 325 and extending in the longitudinal direction. In the illustrated embodiment, the longitudinal stiffening leg 331 is disposed between the first and second longitudinal edges 326, 327 of the slidable vent plate 325, although it will be appreciated that the longitudinal stiffening leg 331 may extend along one of the longitudinal edges 326, 327 of the slidable vent plate 325. In the illustrated embodiment, the first longitudinal edge 326 of the slidable vent plate 325 extends out beyond the longitudinal stiffening leg 331. Additionally, in the illustrated embodiment, the longitudinal stiffening leg 331 extends completely between the transverse edges 328, 329 of the slidable vent plate 325, although it will be appreciated that the longitudinal stiffening leg 331 may not extend completely to the transverse edges 328, 329.

With continued reference to the embodiment illustrated in FIGS. 7A-8B, the first and second longitudinal legs 309, 310 on the base frame 301 each also include an inwardly projecting flange 332. Together, the flanges 332 define a pair of slots 333, 334 (see FIG. 7D) configured to receive portions of the slidable vent plate 325. When the self-closing vent assembly 300 is assembled (i.e., the slidable vent assembly 302 is received in the cavity 320 in the base frame 301), the longitudinal edges 326, 327 of the slidable vent plate 325 extend into the slots 333, 334, respectively, such that the inwardly protruding flanges 332 support the longitudinal edges 326, 327 of the slidable vent plate 325, as illustrated in FIGS. 8A and 8B. Additionally, in the illustrated embodiment, the inwardly protruding flanges 332 on the longitudinal legs 309, 310 are spaced apart from the base vent plate 303 by a distance such that the slidable vent plate 325 abuts the base vent plate 303 (i.e., the inwardly protruding flanges 332 are spaced apart by base vent plate 303 by a distance substantially equal to the thickness of the slidable vent plate 325). Additionally, when the self-closing vent assembly 300 is assembled, the longitudinal stiffening leg 331 on the slidable vent assembly 302 is disposed between the first and second longitudinal legs 309, 310 on the base frame 301.

The slidable vent assembly 302 is configured to slide between an open position (FIGS. 7A, 7B, 8A, and 8C), wherein the apertures 330 in the slidable vent plate 325 are aligned with the apertures 304 in the base vent plate 303, and a closed position (FIGS. 7C, 8B, and 8D), wherein the apertures 330 in the slidable vent plate 325 are laterally offset from the apertures 304 in the base vent plate 303 (i.e., in the closed position, the apertures 330 in the slidable vent plate 325 are offset from the apertures 304 in the base vent plate 303 in the transverse direction along which the shorter edges 328, 329 of the slidable vent plate 325 extend; in the open position, the apertures 330 in the slidable vent plate 325 are concentric with the apertures 304 in the base vent plate 303). As illustrated in FIG. 8A, when the slidable vent assembly 302 is in the open position, the first longitudinal edge 326 of the slidable vent plate 325 abuts the first longitudinal leg 309 of the base frame 301 and a gap 335 is defined between the second longitudinal edge 327 of the slidable vent plate 325 and the second longitudinal leg 310 of the base frame 301. As illustrated in FIG. 8B, when the slidable vent plate 325 is in the closed position, the second longitudinal edge 327 of the slidable vent plate 325 abuts the second longitudinal leg 310 of the base frame 301 and a gap 336 is defined between the first longitudinal edge 326 of the slidable vent plate 325 and the first longitudinal leg 309 of the base frame 301. Accordingly, the first and second longitudinal legs 309, 310 on the base frame 301 are configured to constrain lateral movement of the slidable vent assembly 302 as it slides between the open and closed positions. In one or more alternate embodiment, the longitudinal edges 326, 327 may be configured not to abut the longitudinal legs 309, 310 of the base frame 301.

Figure 8D:
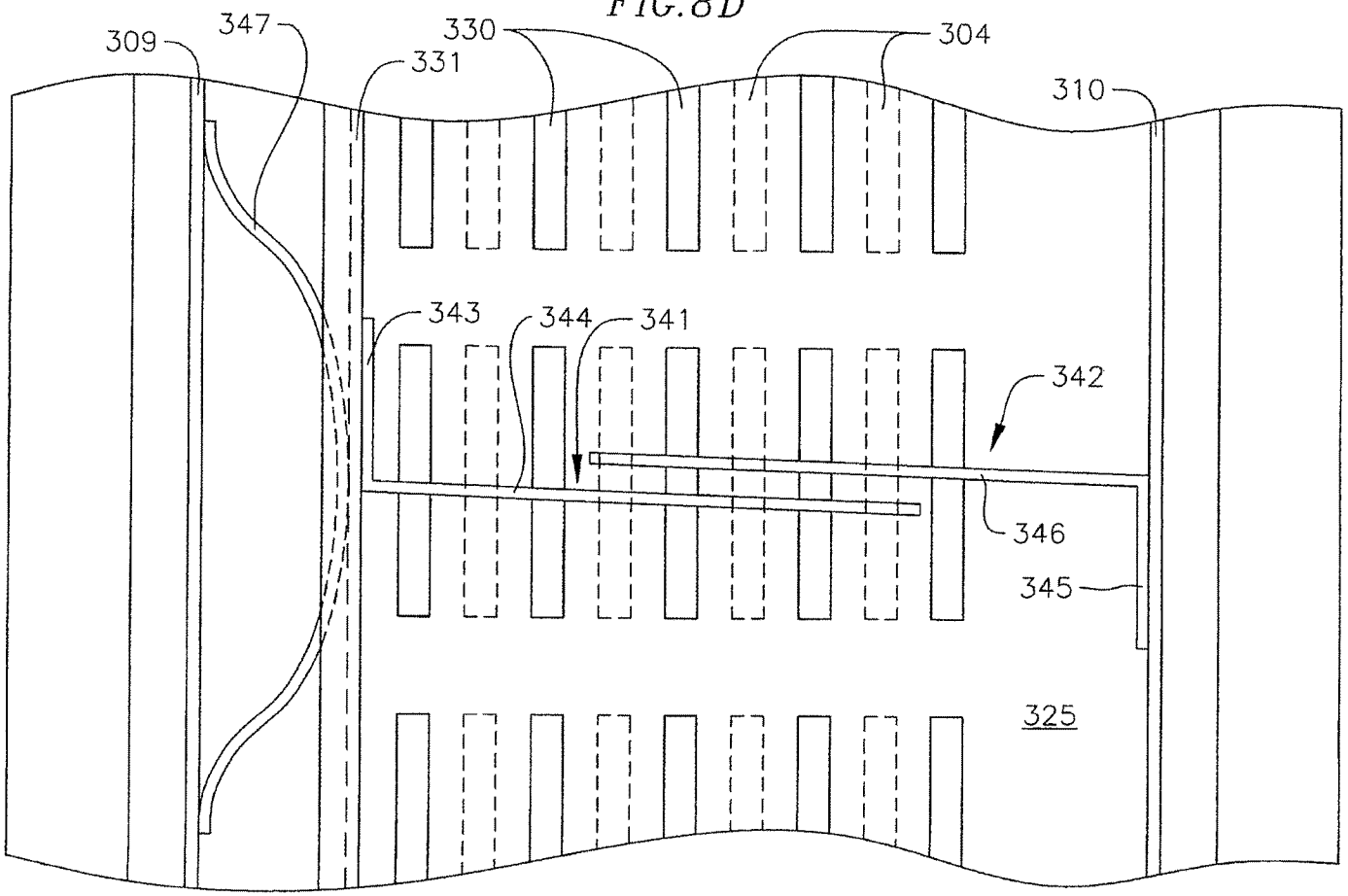

With continued reference to the embodiment illustrated in FIGS. 7A-8D, a mechanical fusible link 340 is provided extending between the second longitudinal leg 310 of the base frame 301 and the longitudinal stiffening leg 331 of the slidable vent assembly 302. The mechanical fusible link 340 is illustrated schematically in FIGS. 8A and 8B. The mechanical fusible link 340 is configured to bias the slidable vent assembly 302 into the open position until a threshold temperature is reached, such as during a fire, at which point the mechanical fusible link 340 is configured to rupture, thereby enabling the slidable vent plate 325 to slide into the closed position. In one embodiment, the mechanical fusible link 340 includes first and second metal strips 341, 342, respectively. In the illustrated embodiment, the first metal strip 341 is L-shaped and includes an outer flange 343 coupled to the longitudinal stiffening leg 331 on the slidable vent assembly 302 and a tab 344 projecting inward from the outer flange 343. Similarly, in the illustrated embodiment, the second metal strip 342 is L-shaped and includes an outer flange 345 coupled to the second longitudinal leg 310 on base frame and a tab 346 projecting inward from the outer flange 345. Portions of the tabs 344, 346 on the first and second strips 341, 342 are soldered together with an alloy configured to melt at a threshold temperature. As illustrated in FIGS. 7C, 8B, and 8D, when the alloy melts, the tabs 344, 346 on the first and second strips 341, 342 are decoupled such that the slidable vent assembly 302 may move into the closed position.

Still referring to the embodiment illustrated in FIGS. 7A-8D, a resilient member 347 is provided extending between the first longitudinal leg 309 on the base frame 301 and the longitudinal stiffening leg 331 on the slidable vent assembly 302. When the strips 341, 342 of the mechanical fusible link 340 are decoupled after being exposed to a high threshold temperature, the resilient member 347 is configured to bias the slidable vent assembly 302 into the closed position such that the apertures 330 in the slidable vent plate 325 are laterally offset from the apertures 304 in the base vent plate 303. In one embodiment, the resilient member 347 may be a spring (e.g., a leaf spring). In an alternate embodiment, the self-closing vent assembly 300 may be provided without the resilient member 347, and the slidable vent assembly 302 may be configured to move into the closed position under the force of gravity (e.g., the self-closing vent assembly 300 may be installed and oriented on a vertical wall member such that slidable vent assembly 302 is configured to slide into the closed position under the force of gravity after the mechanical fusible link 340 has been ruptured). In one embodiment, the alloy coupling the first and second strips 341, 342 of the mechanical fusible link 340 together is configured to melt at approximately 135° F. It will be appreciated, however, that an alloy configured to melt at any other suitable threshold temperature may be provided, such as between approximately 100° F. and approximately 200° F. In the closed position, the self-closing vent assembly 300 is configured to prevent both air and rising embers from passing through the vent 300 (i.e., in the closed position, the self-closing vent assembly 300 is configured to prevent the flow of air and embers through both sets of apertures 304, 330 simultaneously in a direction perpendicular to an imaginary plane extending through the plane of the apertures 330 in the slidable vent plate 325). Such perpendicular flow through the apertures 304, 330 will be prevented by the solid portions of the base vent plate 303 that cover the apertures 330 in the slidable vent plate 325, as illustrated in FIG. 8B. Additionally, in one or more embodiments, any other suitable mechanism may be provided to bias the slidable vent assembly into the open position until a threshold temperature is reached, such as, for example, memory alloy mechanisms or a mechanical switch coupled to an electronic temperature sensor.

The base frames 102, 201, 301, transverse supports 203, floating vent plates 103, 202, and the slidable vent assembly 302 of the present disclosure may be made of any suitable strong and durable material, such as aluminum, steel, or carbon fiber reinforced plastic. The base frames 102, 201, 301, transverse supports 203, floating vent plates 103, 202, and the slidable vent assembly 302 may be made from any suitable process, such as extruding, machining, stamping, pressing, molding, welding, and/or rapid prototyping using additive manufacturing techniques.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function. Additionally, although relative terms such as "outer," "inner," "upper," "lower," "below," "above," "vertical, "horizontal" and similar terms have been used herein to describe a spatial relationship of one element to another, it is understood that these terms are intended to encompass different orientations of the various elements and components of the device in addition to the orientation depicted in the figures. Moreover, although the invention has been described with reference to preventing the spread of a fire in a building, it will be appreciated that the present invention may be used in any other suitable applications.

What is claimed is:

1. A method of permitting the flow of ventilation air through a vent during normal ambient conditions and restricting or preventing the flow and a spread of embers through the vent during a fire, said vent comprising a first vent member having a plurality of first apertures and a second vent member having a plurality of second apertures, the method comprising:

moving by air the first vent member from a first position spaced apart from the second vent member along a direction toward the second vent member to a second position abutting the second vent member when said air has a velocity not less than an activation velocity, wherein the plurality of first apertures are misaligned from the plurality of second apertures axially along an axis along said direction, wherein said plurality of first apertures and said plurality of second apertures are defined along planes generally perpendicular to said direction, and wherein when said first vent member is in said second position, the flow of embers is restricted or prevented through said vent; and allowing the first vent member move to the first position by its own weight when the air velocity is below said activation velocity.

2. The method of claim 1, wherein the first vent member is a floating vent member.

3. The method of claim 1, wherein a plurality of supports are coupled to the second vent member, wherein the plurality of supports are configured to support the first vent member in the first position.

4. The method of claim 1, wherein:

the apertures in the first vent member comprise a plurality of generally rectangular openings disposed in a grid-like pattern; and the apertures in the second vent member comprise a plurality of generally rectangular openings disposed in a grid-like pattern.

5. The method of claim 1, wherein said activation velocity is at least 25 mph.

6. The method of claim 1, wherein said activation velocity is at least 30 mph.

7. The method of claim 1, wherein said activation velocity is at least 37 mph.

8. The method of claim 1, wherein when in the second position, the first vent member prevents air flow through the second plurality of apertures and the second vent member prevents air flow through the first plurality of apertures.

9. The method of claim 1, wherein when in the first position air can flow through the first and second vent members.

10. The method claim 1, wherein the first vent member is a plate member.

11. The method of claim 9, wherein the second vent member comprises a plate member, wherein the second plurality of apertures are formed through said second vent plate.

12. The method of claim 11, wherein said activation velocity is at least 25 mph.

13. The method of claim 11, wherein said activation velocity is at least 30 mph.

14. The method of claim 11, wherein said activation velocity is at least 37 mph.

15. The method of claim 11, wherein when in the second position, the first vent member prevents air flow through the second plurality of apertures and the second vent member prevents air flow through the first plurality of apertures.

16. The method of claim 11, wherein when in the first position air can flow through the first and second vent members.

* * * * *